US010989068B2

(12) United States Patent
Packer et al.

(10) Patent No.: US 10,989,068 B2
(45) Date of Patent: Apr. 27, 2021

(54) TURBINE SHROUD INCLUDING PLURALITY OF COOLING PASSAGES

(71) Applicant: General Electric Company, Schenectady, NY (US)

(72) Inventors: Travis J Packer, Simpsonville, SC (US); Benjamin Paul Lacy, Greer, SC (US); Ibrahim Sezer, Greenville, SC (US); Zachary John Snider, Simpsonville, SC (US); Brad Wilson VanTassel, Easley, SC (US)

(73) Assignee: General Electric Company, Schenectady, NY (US)

( * ) Notice: Subject to any disclaimer, the term of this patent is extended or adjusted under 35 U.S.C. 154(b) by 211 days.

(21) Appl. No.: 16/040,062

(22) Filed: Jul. 19, 2018

(65) Prior Publication Data

US 2020/0025026 A1 Jan. 23, 2020

(51) Int. Cl.
*F01D 25/12* (2006.01)
*F01D 11/08* (2006.01)

(52) U.S. Cl.
CPC ..... *F01D 25/12* (2013.01); *F01D 11/08* (2013.01); *F05D 2240/11* (2013.01); *F05D 2260/201* (2013.01)

(58) Field of Classification Search
CPC ..... F01D 25/12; F01D 11/08; F05D 2240/11; F05D 2260/201
See application file for complete search history.

(56) References Cited

U.S. PATENT DOCUMENTS 3,728,039 A 4/1973 Plemmons et al.
3,825,364 A 7/1974 Halila et al.
4,086,757 A 5/1978 Karstensen et al.
4,573,865 A * 3/1986 Hsia ..... F01D 5/187 165/109.1
4,752,184 A 6/1988 Liang
(Continued)

FOREIGN PATENT DOCUMENTS

WO 2004057159 A1 7/2004

OTHER PUBLICATIONS

U.S. Appl. No. 16/170,331, filed Oct. 25, 2018 ; Non-Final Office Action dated Mar. 20, 2020, (GEEN-1026-US), 23 pages.

*Primary Examiner* — David E Sosnowski
*Assistant Examiner* — Sabbir Hasan
(74) *Attorney, Agent, or Firm* — James Pemrick; Hoffman Warnick LLC

(57) ABSTRACT

Turbine shrouds for turbine systems are disclosed. The turbine shrouds may include a unitary body including a forward and aft end, an outer surface facing a cooling chamber formed between the unitary body and a turbine casing of the turbine system, and an inner surface facing a hot gas flow path. The shrouds may also include a first cooling passage extending within the unitary body, and a plurality of impingement openings formed through the outer surface of the unitary body to fluidly couple the first cooling passage to the cooling chamber. Additionally, the shrouds may include a second cooling passage and/or a third cooling passage. The second cooling passage may extend adjacent the forward end and may be in fluid communication with the first cooling passage. The third cooling passage may extend adjacent the aft end, and may be in fluid communication with the first cooling passage.

20 Claims, 18 Drawing Sheets

(56) References Cited

U.S. PATENT DOCUMENTS

| | | | | |
|---|---|---|---|---|
| 5,169,287 | A | 12/1992 | Proctor et al. | |
| 5,197,853 | A | 3/1993 | Creevy et al. | |
| 5,584,651 | A | 12/1996 | Pietraszkiewicz et al. | |
| 6,179,557 | B1 | 1/2001 | Dodd et al. | |
| 6,241,467 | B1 | 6/2001 | Zelesky et al. | |
| 6,354,795 | B1 | 3/2002 | White et al. | |
| 6,779,597 | B2 | 8/2004 | DeMarche et al. | |
| 6,841,402 | B1 | 1/2005 | Hirayanagi | |
| 7,517,189 | B2 * | 4/2009 | Camus | F01D 9/04 415/173.1 |
| 7,740,444 | B2 | 6/2010 | Lee et al. | |
| 8,353,663 | B2 | 1/2013 | Arzel et al. | |
| 8,814,507 | B1 | 8/2014 | Campbell et al. | |
| 9,080,458 | B2 | 7/2015 | Romanov | |
| 9,103,225 | B2 | 8/2015 | Lutjen et al. | |
| 9,404,379 | B2 | 8/2016 | Mishra | |
| 9,670,785 | B2 | 6/2017 | Johns et al. | |
| 9,719,372 | B2 | 8/2017 | Ballard et al. | |
| 10,107,128 | B2 | 10/2018 | Romanov et al. | |
| 10,221,717 | B2 | 3/2019 | Manchikanti et al. | |
| 10,612,385 | B2 * | 4/2020 | Schetzel | F01D 5/284 |
| 2005/0232752 | A1 | 10/2005 | Meisels | |
| 2005/0281663 | A1 | 12/2005 | Trindade et al. | |
| 2009/0035125 | A1 | 2/2009 | Fujimoto et al. | |
| 2010/0111670 | A1 | 5/2010 | Shapiro | |
| 2010/0196160 | A1 | 8/2010 | Hudson | |
| 2011/0044804 | A1 | 2/2011 | DiPaola et al. | |
| 2012/0020768 | A1 | 1/2012 | Krueckels et al. | |
| 2012/0201650 | A1 | 8/2012 | Suthar et al. | |
| 2012/0219401 | A1 | 8/2012 | Rawlinson et al. | |
| 2013/0142649 | A1 | 6/2013 | Collier et al. | |
| 2013/0192257 | A1 | 8/2013 | Horine et al. | |
| 2013/0315719 | A1 | 11/2013 | Rogers et al. | |
| 2014/0023497 | A1 | 1/2014 | Giglio et al. | |
| 2014/0321961 | A1 | 10/2014 | Beattie et al. | |
| 2015/0007581 | A1 | 1/2015 | Sezer et al. | |
| 2015/0118022 | A1 | 4/2015 | Weber et al. | |
| 2016/0169037 | A1 | 6/2016 | Lefebvre et al. | |
| 2016/0258311 | A1 | 9/2016 | Varney et al. | |
| 2016/0362985 | A1 | 12/2016 | Lacy et al. | |
| 2017/0101892 | A1 | 4/2017 | Dutta et al. | |
| 2017/0145845 | A1 | 5/2017 | Vetters et al. | |
| 2017/0175572 | A1 | 6/2017 | Vetters | |
| 2017/0298823 | A1 | 10/2017 | Harding | |
| 2017/0314414 | A1 | 11/2017 | Lefebvre et al. | |
| 2018/0073391 | A1 | 3/2018 | Jennings | |
| 2018/0100409 | A1 | 4/2018 | Cochet et al. | |
| 2018/0230806 | A1 | 8/2018 | Zemitis et al. | |
| 2018/0363499 | A1 | 12/2018 | Smoke et al. | |
| 2019/0170001 | A1 | 6/2019 | Frach et al. | |
| 2019/0178102 | A1 | 6/2019 | Synnott et al. | |

* cited by examiner

TURBINE SHROUD INCLUDING PLURALITY OF COOLING PASSAGES

BACKGROUND OF THE INVENTION

The disclosure relates generally to turbine shrouds for turbine systems, and more particularly, to unitary body turbine shrouds that include a plurality of cooling passages formed therein.

Conventional turbomachines, such as gas turbine systems, are utilized to generate power for electric generators. In general, gas turbine systems generate power by passing a fluid (e.g., hot gas) through a turbine component of the gas turbine system. More specifically, inlet air may be drawn into a compressor and may be compressed. Once compressed, the inlet air is mixed with fuel to form a combustion product, which may be ignited by a combustor of the gas turbine system to form the operational fluid (e.g., hot gas) of the gas turbine system. The fluid may then flow through a fluid flow path for rotating a plurality of rotating blades and rotor or shaft of the turbine component for generating the power. The fluid may be directed through the turbine component via the plurality of rotating blades and a plurality of stationary nozzles or vanes positioned between the rotating blades. As the plurality of rotating blades rotate the rotor of the gas turbine system, a generator, coupled to the rotor, may generate power from the rotation of the rotor.

To improve operational efficiencies turbine components may include turbine shrouds and/or nozzle bands to further define the flow path of the operational fluid. Turbine shrouds, for example, may be positioned radially adjacent rotating blades of the turbine component and may direct the operational fluid within the turbine component and/or define the outer bounds of the fluid flow path for the operational fluid. During operation, turbine shrouds may be exposed to high temperature operational fluids flowing through the turbine component. Over time and/or during exposure, the turbine shrouds may undergo undesirable thermal expansion. The thermal expansion of turbine shrouds may result in damage to the shrouds and/or may not allow the shrouds to maintain a seal within the turbine component for defining the fluid flow path for the operational fluid. When the turbine shrouds become damaged or no longer form a satisfactory seal within the turbine component, the operational fluid may leak from the flow path, which in turn reduces the operational efficiency of the turbine component and the entire turbine system.

To minimize thermal expansion, turbine shrouds are typically cooled. Conventional processes for cooling turbine shrouds include film cooling and impingement cooling. Film cooling involves the process of flowing cooling air over the surfaces of the turbine shroud during operation of the turbine component. Impingement cooling utilizes holes or apertures formed through the turbine shroud to provide cooling air to various portions of the turbine shroud during operation.

Each of these cooling processes create issues during operation of the turbine component. For example, the cooling air utilized in film cooling may mix with the operational fluid flowing through the fluid flow path, and may cause turbulence within the turbine component. Additionally, turbine shrouds often have patterned surfaces that may improve sealing with the rotor during operation. However, the patterned surfaces are not usually conducive with film cooling processes for cooling the shroud. Impingement cooling is most effective if the exterior wall of the shroud is as thin as possible. However, structural requirements may mandate a thicker wall, which in turn reduces the effectiveness of impingement cooling. Additionally, in order to form impingement holes or apertures through various portions of the turbine shroud, the turbine shroud must be formed from multiple pieces that must be assembled and/or secured together prior to being installed into the turbine component. As the number of pieces assembled to form the turbine shroud increases, so may the likelihood of possible uncoupling and/or damage to the turbine shroud and/or the turbine component.

BRIEF DESCRIPTION OF THE INVENTION

A first aspect of the disclosure provides a turbine shroud coupled to a turbine casing of a turbine system. The turbine shroud includes: a unitary body including: a forward end; an aft end positioned opposite the forward end; an outer surface facing a cooling chamber formed between the unitary body and the turbine casing; and an inner surface facing a hot gas flow path for the turbine system; a first cooling passage extending within the unitary body, the first cooling passage including a forward part positioned adjacent the forward end of the unitary body, an aft part positioned adjacent the aft end of the unitary body, and a central part positioned between the forward part and the aft part; a plurality of impingement openings formed through the outer surface of the unitary body to fluidly couple the first cooling passage to the cooling chamber; and at least one of: a second cooling passage extending within the unitary body adjacent the forward end, the second cooling passage in fluid communication with the first cooling passage, or a third cooling passage extending within the unitary body adjacent the aft end, the third cooling passage in fluid communication with the first cooling passage.

A second aspect of the disclosure provides a turbine system including: a turbine casing; and a first stage positioned within the turbine casing. The first stage includes: a plurality of turbine blades positioned within the turbine casing and circumferentially about a rotor; a plurality of stator vanes positioned within the turbine casing, downstream of the plurality of turbine blades; and a plurality of turbine shrouds positioned radially adjacent the plurality of turbine blades and upstream of the plurality of stator vanes, each of the plurality of turbine shrouds including: a unitary body including: a forward end; an aft end positioned opposite the forward end; an outer surface facing a cooling chamber formed between the unitary body and the turbine casing; and an inner surface facing a hot gas flow path for the turbine system; a first cooling passage extending within the unitary body, the first cooling passage including a forward part positioned adjacent the forward end of the unitary body, an aft part positioned adjacent the aft end of the unitary body, and a central part positioned between the forward part and the aft part; a plurality of impingement openings formed through the outer surface of the unitary body to fluidly couple the first cooling passage to the cooling chamber; and at least one of: a second cooling passage extending within the unitary body adjacent the forward end, the second cooling passage in fluid communication with the first cooling passage, or a third cooling passage extending within the unitary body adjacent the aft end, the third cooling passage in fluid communication with the first cooling passage.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
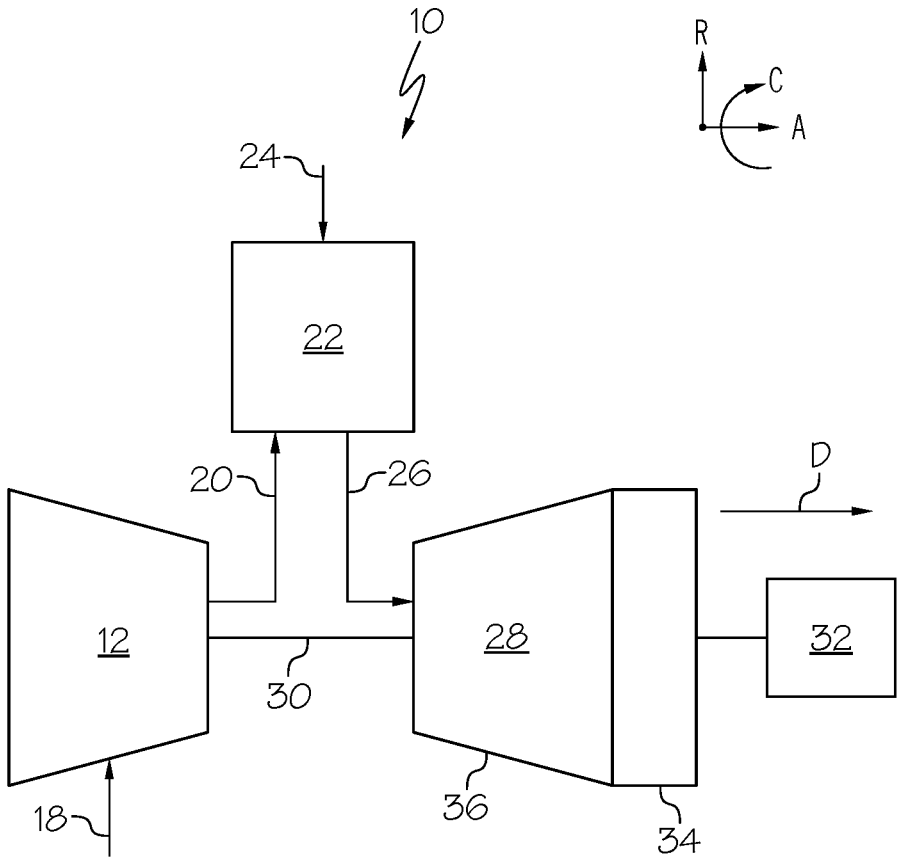
FIG. 1 shows a schematic diagram of a gas turbine system, according to embodiments of the disclosure.

As an initial matter, in order to clearly describe the current disclosure it will become necessary to select certain terminology when referring to and describing relevant machine components within the scope of this disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the engine, and "aft" referring to the rearward or turbine end of the engine. Additionally, the terms "leading" and "trailing" may be used and/or understood as being similar in description as the terms "forward" and "aft," respectively. It is often required to describe parts that are at differing radial, axial and/or circumferential positions. The "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along a direction "R" (see, FIG. 1), which is substantially perpendicular with axis A and intersects axis A at only one location. Finally, the term "circumferential" refers to movement or position around axis A (e.g., direction "C").

As indicated above, the disclosure provides turbine shrouds for turbine systems, and more particularly, unitary body turbine shrouds that include a plurality of cooling passages formed therein.

These and other embodiments are discussed below with reference to FIGS. 1-18. However, those skilled in the art will readily appreciate that the detailed description given herein with respect to these Figures is for explanatory purposes only and should not be construed as limiting.

FIG. 1 shows a schematic view of an illustrative gas turbine system 10. Gas turbine system 10 may include a compressor 12. Compressor 12 compresses an incoming flow of air 18. Compressor 12 delivers a flow of compressed air 20 to a combustor 22. Combustor 22 mixes the flow of compressed air 20 with a pressurized flow of fuel 24 and ignites the mixture to create a flow of combustion gases 26. Although only a single combustor 22 is shown, gas turbine system 10 may include any number of combustors 22. The flow of combustion gases 26 is in turn delivered to a turbine 28, which typically includes a plurality of turbine blades including airfoils (see, FIG. 2) and stator vanes (see, FIG. 2). The flow of combustion gases 26 drives turbine 28, and more specifically the plurality of turbine blades of turbine 28, to produce mechanical work. The mechanical work produced in turbine 28 drives compressor 12 via a rotor 30 extending through turbine 28, and may be used to drive an external load 32, such as an electrical generator and/or the like.

Gas turbine system 10 may also include an exhaust frame 34. As shown in FIG. 1, exhaust frame 34 may be positioned adjacent to turbine 28 of gas turbine system 10. More specifically, exhaust frame 34 may be positioned adjacent to turbine 28 and may be positioned substantially downstream of turbine 28 and/or the flow of combustion gases 26 flowing from combustor 22 to turbine 28. As discussed herein, a portion (e.g., outer casing) of exhaust frame 34 may be coupled directly to an enclosure, shell, or casing 36 of turbine 28.

Subsequent to combustion gases 26 flowing through and driving turbine 28, combustion gases 26 may be exhausted, flow-through and/or discharged through exhaust frame 34 in a flow direction (D). In the non-limiting example shown in FIG. 1, combustion gases 26 may flow through exhaust frame 34 in the flow direction (D) and may be discharged from gas turbine system 10 (e.g., to the atmosphere). In another non-limiting example where gas turbine system 10 is part of a combined cycle power plant (e.g., including gas turbine system and a steam turbine system), combustion gases 26 may discharge from exhaust frame 34, and may flow in the flow direction (D) into a heat recovery steam generator of the combined cycle power plant.

Figure 2:
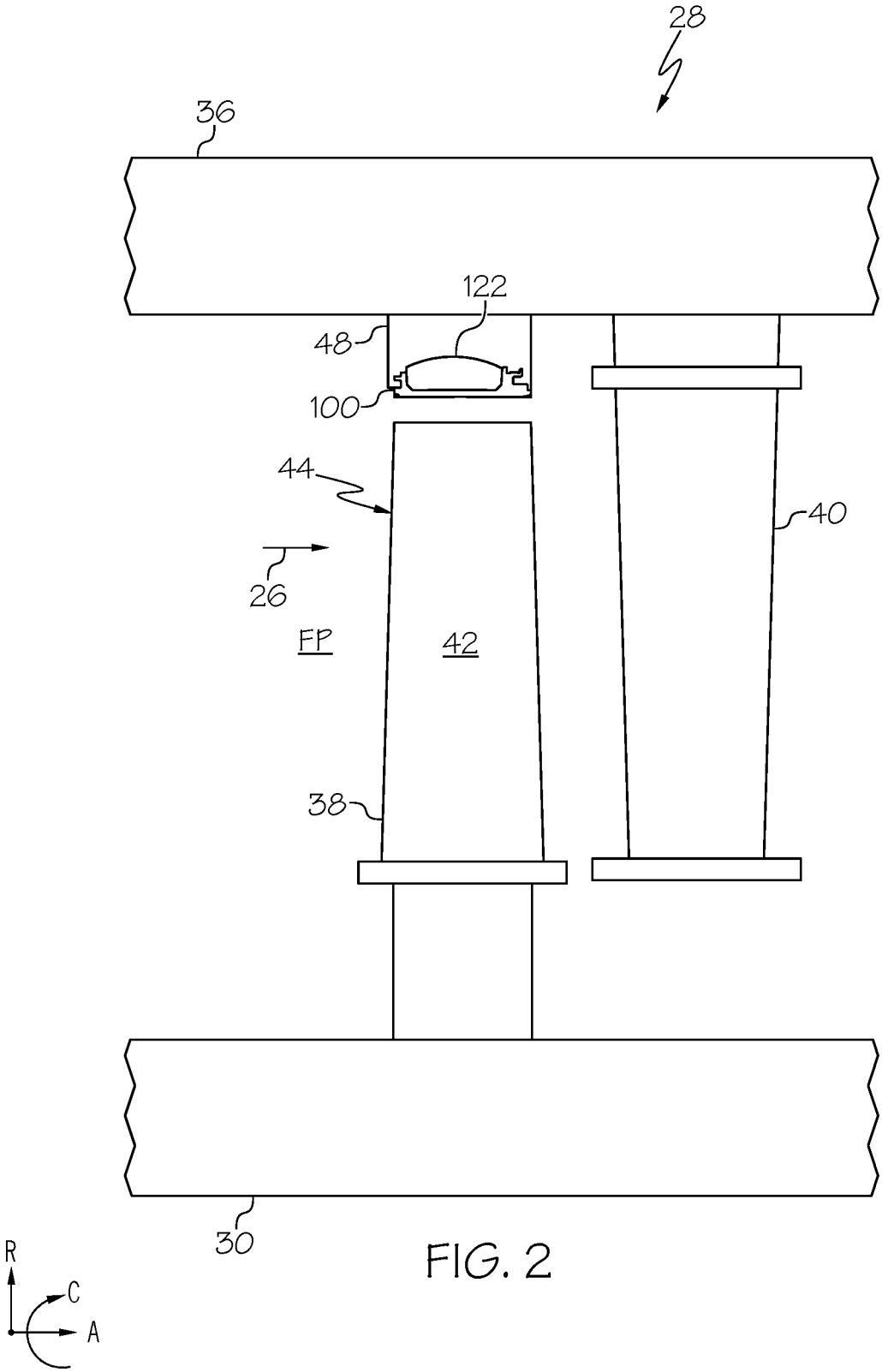
FIG. 2 shows a side view of a portion of a turbine of the gas turbine system of FIG. 1 including a turbine blade, a stator vane, a rotor, a casing, and a turbine shroud, according to embodiments of the disclosure.

Turning to FIG. 2, a portion of turbine 28 is shown. Specifically, FIG. 2 shows a side view of a portion of turbine 28 including a first stage of turbine blades 38 (one shown), and a first stage of stator vanes 40 (one shown) coupled to casing 36 of turbine 28. As discussed herein, each stage (e.g., first stage, second stage (not shown), third stage (not shown)) of turbine blades 38 may include a plurality of turbine blades 38 that may be coupled to and positioned circumferentially around rotor 30 and may be driven by combustion gases 26 to rotate rotor 30. Additionally, each stage (e.g., first stage, second stage (not shown), third stage (not shown)) of stator vanes 40 may include a plurality of stator vanes that may be coupled to and positioned circumferentially about casing 36 of turbine 28. Each turbine blade 38 of turbine 28 may include an airfoil 42 extending radially from rotor 30 and positioned within the flow path (FP) of combustion gases 26 flowing through turbine 28. Each airfoil 42 may include a tip portion 44 positioned radially opposite rotor 30. Turbine blades 38 and stator vanes 40 may also be positioned axially adjacent to one another within casing 36. In the non-limiting example shown in FIG. 2, first stage of stator vanes 40 may be positioned axially adjacent and downstream of first stage of turbine blades 38. Not all turbine blades 38, stator vanes 40 and/or all of rotor 30 of turbine 28 are shown for clarity. Additionally, although only a portion of the first stage of turbine blades 38 and stator vanes 40 of turbine 28 are shown in FIG. 2, turbine 28 may include a plurality of stages of turbine blades and stator vanes, positioned axially throughout casing 36 of turbine 28.

Turbine 28 of gas turbine system 10 (see, FIG. 1) may also include a plurality of turbine shrouds 100. For example, turbine 28 may including a first stage of turbine shrouds 100 (one shown). The first stage of turbine shrouds 100 may correspond with the first stage of turbine blades 38 and/or the first stage of stator vanes 40. That is, and as discussed herein, the first stage of turbine shrouds 100 may be positioned within turbine 28 adjacent the first stage of turbine blades 38 and/or the first stage of stator vanes 40 to interact with and provide a seal in the flow path (FP) of combustion gases 26 flowing through turbine 28. In the non-limiting example shown in FIG. 2, the first stage of turbine shrouds 100 may be positioned radially adjacent and/or may substantially surround or encircle the first stage of turbine blades 38. First stage of turbine shrouds 100 may be positioned radially adjacent tip portion 44 of airfoil 42 for turbine blade 38. Additionally, first stage of turbine shrouds 100 may also be positioned axially adjacent and/or upstream of the first stage of stator vanes 40 of turbine 28.

Similar to stator vanes 40, first stage of turbine shrouds 100 may include a plurality of turbine shrouds 100 that may be coupled to and positioned circumferentially about casing 36 of turbine 28. In the non-limiting example shown in FIG. 2 turbine shrouds 100 may be coupled to casing 36 via coupling component 48 extending radially inward from casing 36 of turbine 28. Coupling component 48 may be configured to be coupled to and/or receive fasteners or hooks 102, 104 (FIG. 3) of turbine shrouds 100 to couple, position, and/or secure turbine shrouds 100 to casing 36 of turbine 28. In the non-limiting example, coupling component 48 may be coupled and/or fixed to casing 36 of turbine 28. In another non-limiting example (not shown), coupling component 48 may be formed integral with casing 36 for coupling, positioning, and/or securing turbine shrouds 100 to casing 36. Similar to turbine blades 38 and/or stator vanes 40, although only a portion of the first stage of turbine shrouds 100 of turbine 28 is shown in FIG. 2, turbine 28 may include a plurality of stages of turbine shrouds 100, positioned axially throughout casing 36 of turbine 28.

Figure 3:
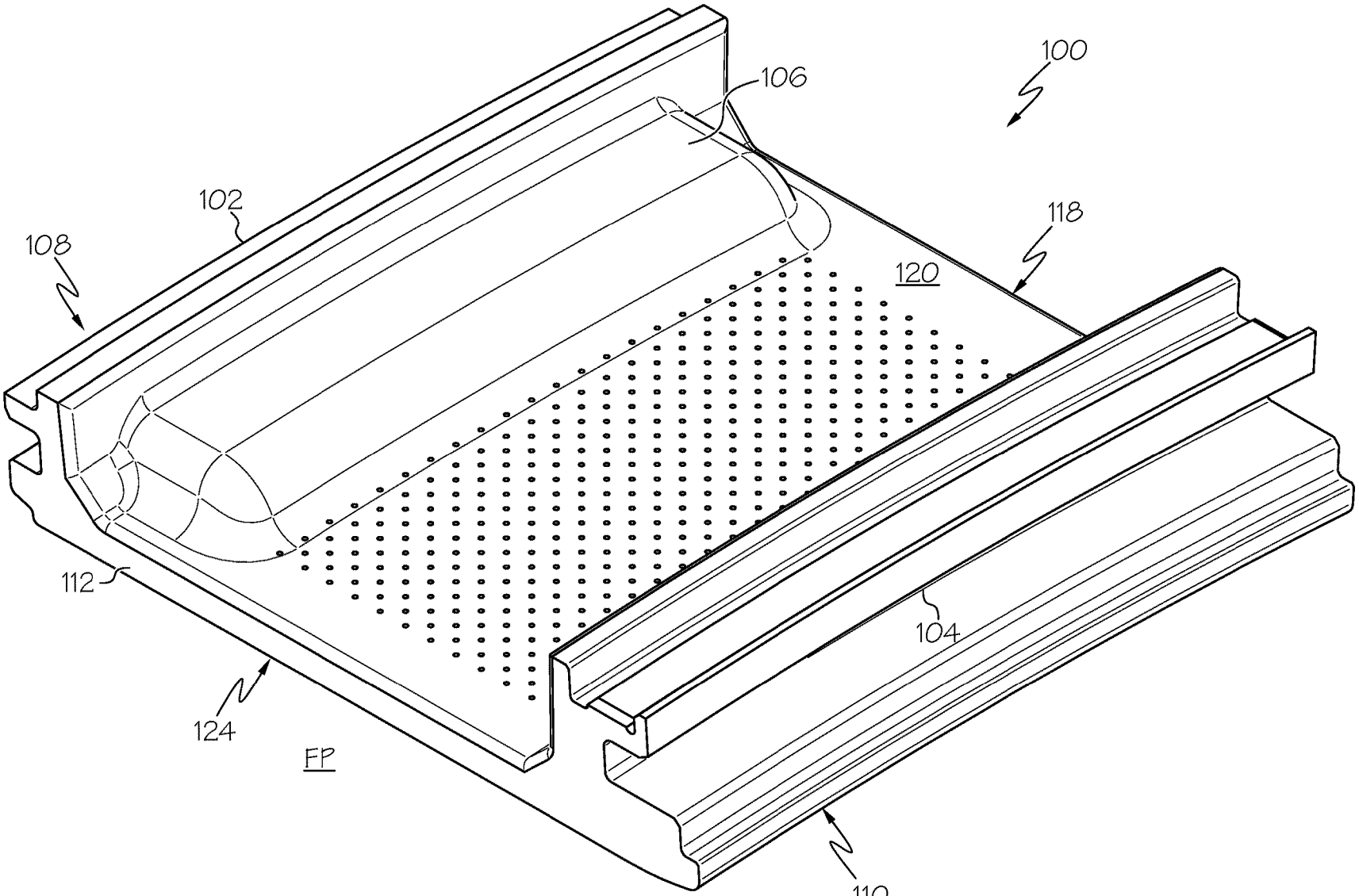
FIG. 3 shows an isometric view of the turbine shroud of FIG. 2, according to embodiments of the disclosure.
Figure 4:
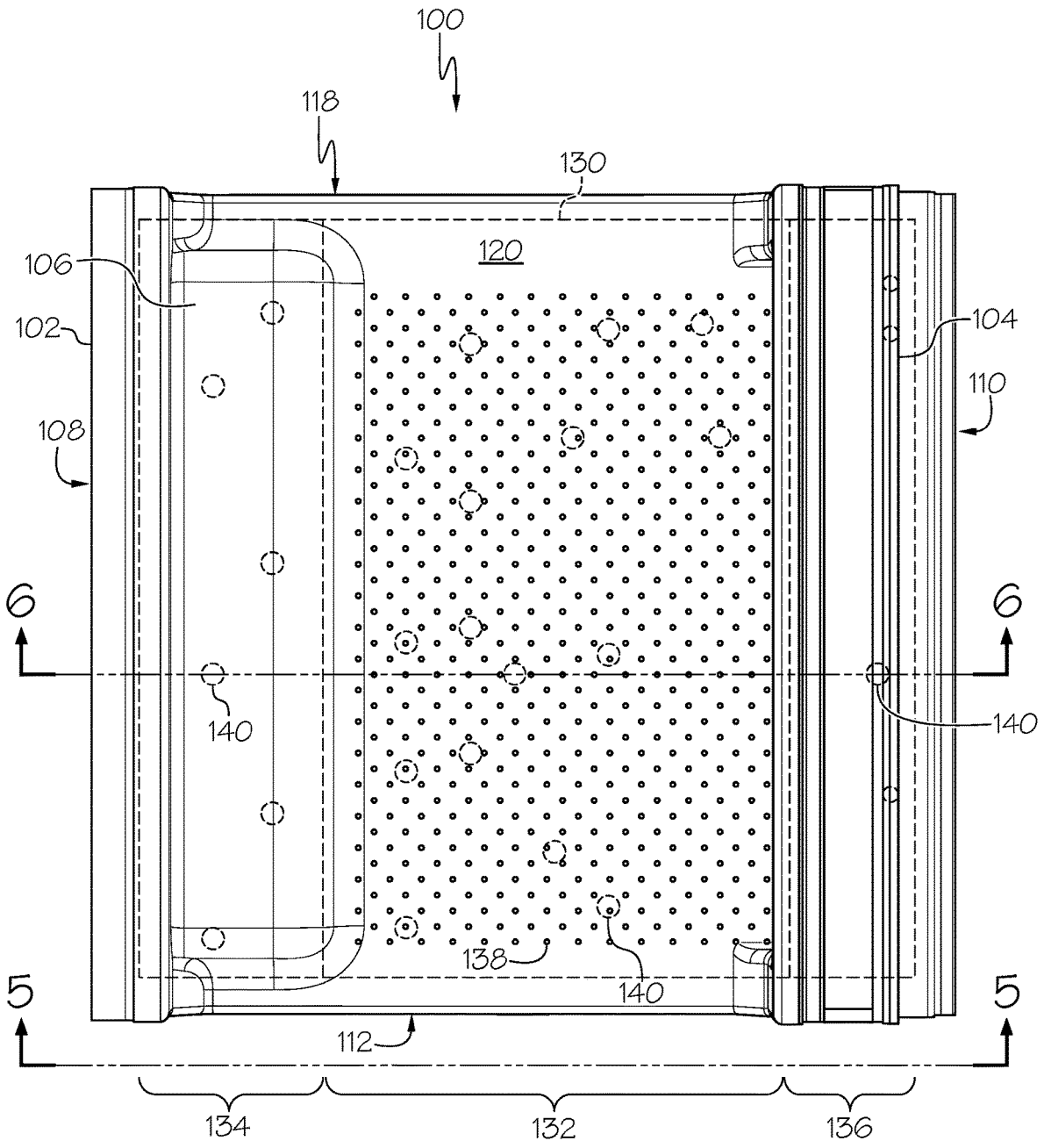
FIG. 4 shows a top view of the turbine shroud of FIG. 3, according to embodiments of the disclosure.
Figure 5:
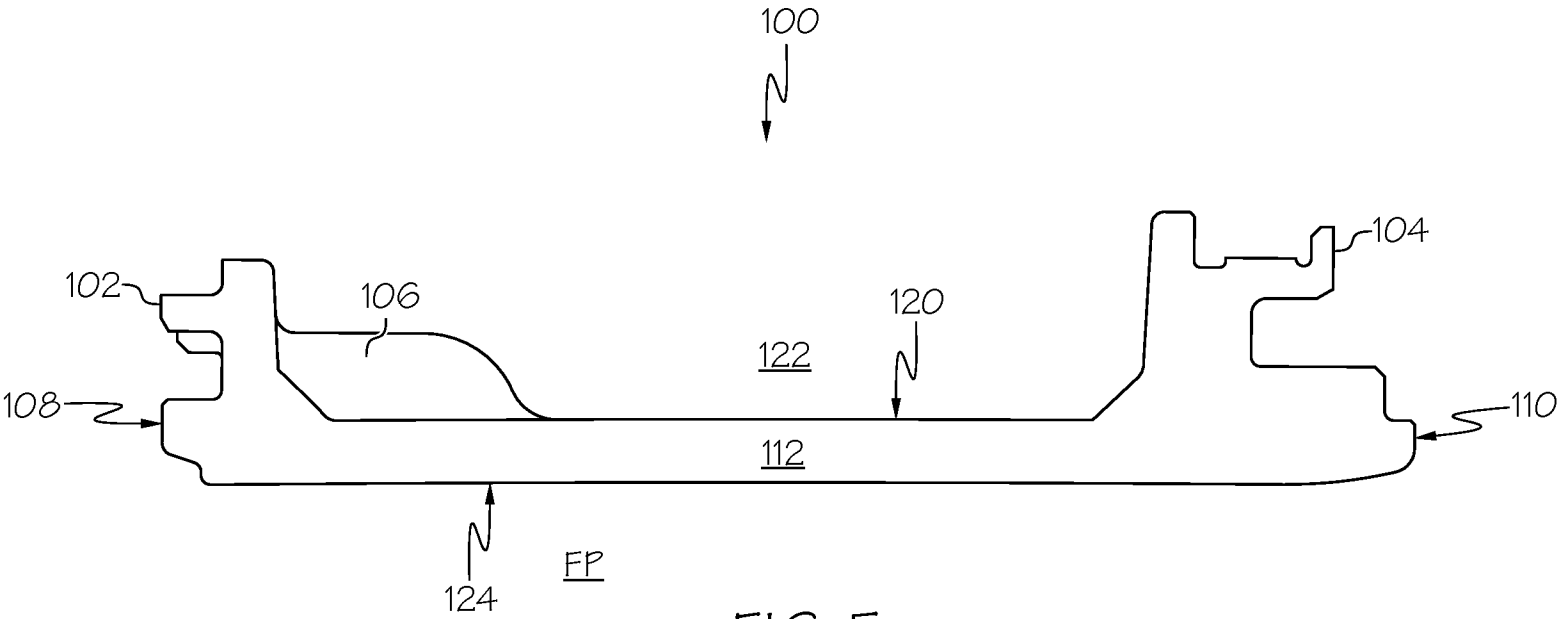
FIG. 5 shows a side view of the turbine shroud of FIG. 3, according to embodiments of the disclosure.
Figure 6:
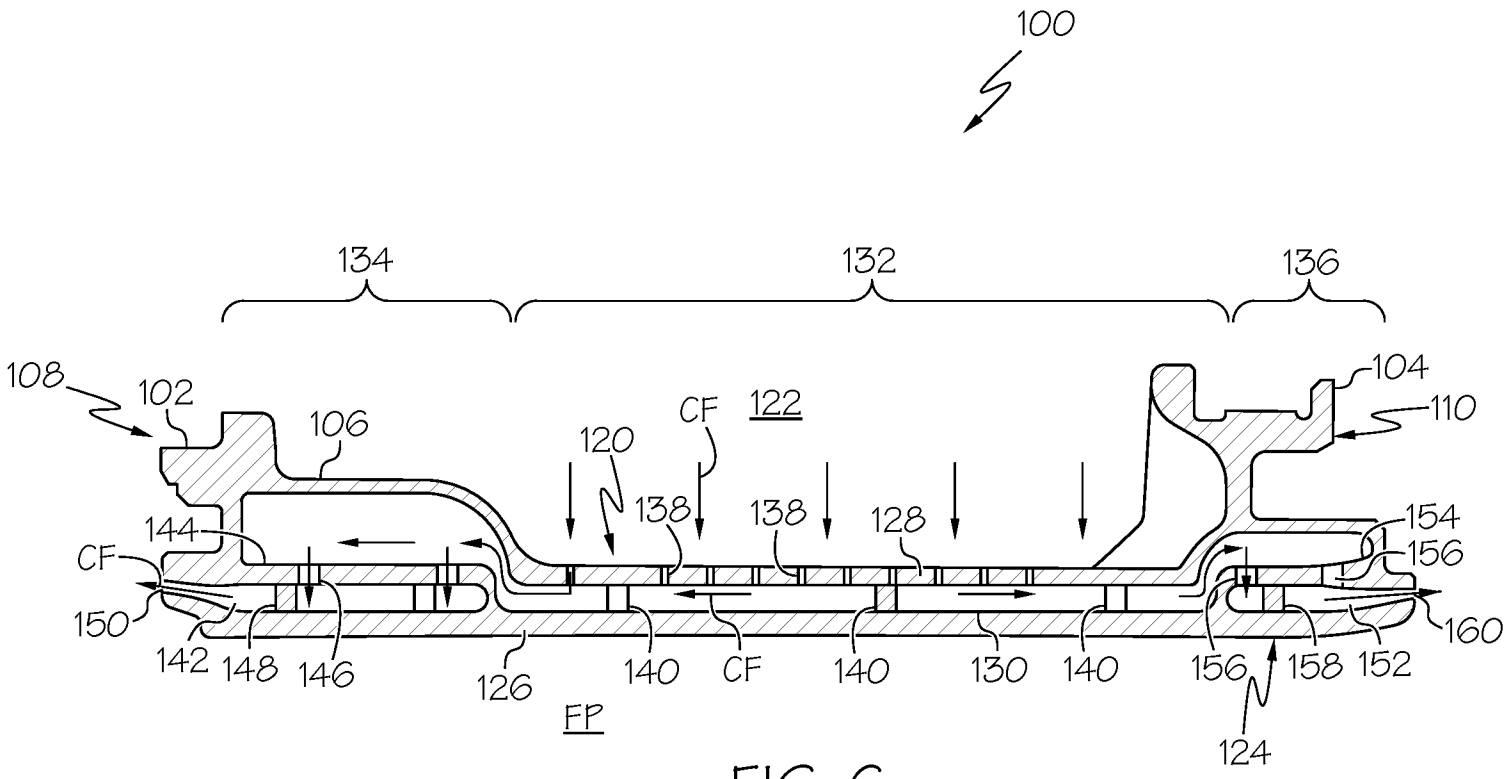
FIG. 6 shows a cross-sectional side view of the turbine shroud taken along line 6-6 in FIG. 4, according to embodiments of the disclosure.

Turning to FIGS. 3-6 show various views of turbine shroud 100 of turbine 28 for gas turbine system 10 of FIG. 1. Specifically, FIG. 3 shows an isometric view of turbine shroud 100, FIG. 4 shows a top view of turbine shroud 100, FIG. 5 shows a side view of turbine shroud 100, and FIG. 6 shows a cross-sectional side view of turbine shroud 100.

Turbine shroud 100 may include a unitary body 106. That is, and as shown in FIGS. 3-6, turbine shroud 100 may include and/or be formed as unitary body 106 such that turbine shroud 100 is a single, continuous, and/or non-disjointed component or part. In the non-limiting example shown in FIGS. 3-6, because turbine shroud 100 is formed from unitary body 106, turbine shroud 100 may not require the building, joining, coupling, and/or assembling of various parts to completely form turbine shroud 100, and/or may not require building, joining, coupling, and/or assembling of various parts before turbine shroud 100 can be installed and/or implemented within turbine system 10 (see, FIG. 2). Rather, once single, continuous, and/or non-disjointed unitary body 106 for turbine shroud 100 is built, as discussed herein, turbine shroud 100 may be immediately installed within turbine system 10.

Unitary body 106 of turbine shroud 100, and the various components and/or features of turbine shroud 100, may be formed using any suitable additive manufacturing process(es) and/or method. For example, turbine shroud 100 including unitary body 106 may be formed by direct metal laser melting (DMLM) (also referred to as selective laser melting (SLM)), direct metal laser sintering (DMLS), electronic beam melting (EBM), stereolithography (SLA), binder jetting, or any other suitable additive manufacturing process(es). Additionally, unitary body 106 of turbine shroud 100 may be formed from any material that may be utilized by additive manufacturing process(es) to form turbine shroud 100, and/or capable of withstanding the operational characteristics (e.g., exposure temperature, exposure pressure, and the like) experienced by turbine shroud 100 within gas turbine system 10 during operation.

Turbine shroud 100 may also include various ends, sides, and/or surfaces. For example, and as shown in FIGS. 3 and 4, unitary body 106 of turbine shroud 100 may include a forward end 108 and an aft end 110 positioned opposite forward end 108. Forward end 108 may be positioned upstream of aft end 110, such that combustion gases 26 flowing through the flow path (FP) defined within turbine 28 may flow adjacent forward end 108 before flowing by adjacent aft end 110 of unitary body 106 of turbine shroud 100. As shown in FIGS. 3 and 4, forward end 108 may include first hook 102 configured to be coupled to and/or engage coupling component 48 of casing 36 for turbine 28 to couple, position, and/or secure turbine shrouds 100 within casing 36 (see, FIG. 2). Additionally, aft end 110 may include second hook 104 positioned and/or formed on unitary body 106 opposite first hook 102. Similar to first hook 102, second hook 104 may be configured to be coupled to and/or engage coupling component 48 of casing 36 for turbine 28 to couple, position, and/or secure turbine shrouds 100 within casing 36 (see, FIG. 2).

Additionally, unitary body 106 of turbine shroud 100 may also include a first side 112, and a second side 118 positioned opposite first side 112. As shown in FIGS. 3 and 4, first side 112 and second side 118, each of which may extend and/or be formed between forward end 108 and aft end 110. Briefly turning to FIG. 5, first side 112 and second side 118 (not shown) of unitary body 106 may be substantially closed and/or may include solid end walls or caps. As such, and as discussed herein, the solid end walls of first side 112 and second side 118 may substantially prevent fluid within turbine 28 (e.g., combustion gases 26, cooling fluids) from entering turbine shroud 100, and/or cooling fluid from exiting internal portions (e.g., passages) formed within turbine shroud 100.

As shown in FIGS. 3-5 unitary body 106 of turbine shroud 100 may also include an outer surface 120. Outer surface 120 may face a cooling chamber 122 formed between unitary body 106 and turbine casing 36 (see, FIG. 2). More specifically, outer surface 120 may be positioned, formed, face, and/or directly exposed in cooling chamber 122 formed between unitary body 106 of turbine shroud 100 and turbine casing 36 of turbine 28. As discussed herein, cooling chamber 122 formed between unitary body 106 of turbine shroud 100 and turbine casing 36 may receive and/or provide cooling fluid to turbine shroud 100 during operation of turbine 28. In addition to facing cooling chamber 122, outer surface 120 of unitary body 106 for turbine shroud 100 may also be formed and/or positioned between forward end 106 and aft end 108, as well as first side 112 and second side 118, respectively.

Unitary body 106 of turbine shroud 100 may also include inner surface 124 formed opposite outer surface 120. That is, and as shown in the non-limiting example in FIGS. 3 and 5, inner surface 124 of unitary body 106 of turbine shroud 100 may be formed radially opposite outer surface 120. Briefly returning to FIG. 2, and with continued reference to FIGS. 3 and 5, inner surface 124 may face the hot gas flow path (FP) of combustion gases 26 flowing through turbine 28 (see, FIG. 2). More specifically, inner surface 124 may be positioned, formed, face, and/or directly exposed to the hot gas flow path (FP) of combustion gases 26 flowing through turbine casing 36 of turbine 28 for gas turbine system 10. Additionally as shown in FIG. 2, inner surface 124 of unitary body 106 for turbine shroud 100 may be positioned radially adjacent tip portion 44 of airfoil 42. In addition to facing the hot gas flow path (FP) of combustion gases 26, and similar to outer surface 120, inner surface 124 of unitary body 106 for turbine shroud 100 may also be formed and/or positioned between forward end 106 and aft end 108, and first side 112 and second side 118, respectively.

Turning to FIG. 6, with continued reference to FIGS. 3-5, additional features of turbine shroud 100 are now discussed. Turbine shroud 100 may include a base portion 126. As shown in FIG. 6, base portion 126 may be formed as an integral portion of unitary body 106 for turbine shroud 100. Additionally, base portion 126 may include inner surface 124, and/or inner surface 124 may be formed on base portion 126 of unitary body 106 for turbine shroud 100. Base portion 126 of unitary body 106 for turbine shroud 100 may be formed, positioned, and/or extend between forward end 106 and aft end 108, and first side 112 and second side 118, respectively. Additionally, base portion 126 may be formed integral with the solid side walls formed on first side 112 and second side 118 of unitary body 106. In the non-limiting example, base portion 126 of unitary body 106 for turbine shroud 100 may have a thickness between approximately 1.25 millimeters (mm) (0.05 inches (in)) and approximately 6.35 mm (0.25 in). As discussed herein, base portion 126 of turbine shroud 100 may at least partially form and/or define at least one cooling passage within turbine shroud 100.

Turbine shroud 100 may include an impingement portion 128. Similar to base portion 126, as shown in FIG. 6, impingement portion 128 may be formed as an integral portion of unitary body 106 for turbine shroud 100. Impingement portion 128 may include outer surface 120, and/or outer surface 120 may be formed on impingement portion 128 of unitary body 106 for turbine shroud 100. Impingement portion 128 of unitary body 106 for turbine shroud 100 may be formed, positioned, and/or extend between forward end 106 and aft end 108, and first side 112 and second side 118, respectively. Additionally, and also similar to base portion 126, impingement portion 128 may be formed integral with the solid side walls formed on first side 112 and second side 118 of unitary body 106. In the non-limiting example where turbine shroud 100 is formed as unitary body 106, impingement portion 128 may have a thickness of between approximately 1.25 mm (0.05 in) and approximately 6.35 mm (0.25 in). Impingement portion 128 of turbine shroud 100, along with base portion 126, may at least partially form and/or define at least one cooling passage within turbine shroud 100, as discussed herein.

Turbine shroud 100 may also include a plurality of cooling passages formed therein for cooling turbine shroud 100 during operation of turbine 28 of gas turbine system 10. As shown in FIG. 6, turbine shroud 100 may include a first cooling passage 130 formed, positioned, and/or extending within unitary body 106 of turbine shroud 100. More specifically, and briefly returning to FIG. 4, first cooling passage 130 (shown in phantom in FIG. 4) of turbine shroud 100 may extend within unitary body 106 between and/or adjacent forward end 108, aft end 110, first side 112, and second side 118, respectively. Additionally, first cooling passage 130 may extend within unitary body 106 between and/or may be at least partially defined by base portion 126 and impingement portion 128. As discussed herein, first cooling passage 130 may receive cooling fluid from cooling chamber 122 to cool turbine shroud 100.

First cooling passage 130 may include a plurality of distinct segments, sections, and/or parts. For example, first cooling passage 130 may include a central part 132 positioned and/or extending between a forward part 134, and an aft part 136. As shown in FIG. 6, central part 132 of first cooling passage 130 may be centrally formed and/or positioned between forward end 108 and aft end 110 of unitary body 106 for turbine shroud 100. Forward part 134 of first cooling passage 130 may be formed and/or positioned directly adjacent forward end 108 of unitary body 106 for turbine shroud 100, and axially adjacent and/or axially upstream of central part 132. Similarly, aft part 136 of first cooling passage 130 may be formed and/or positioned directly adjacent aft end 110 of unitary body 106, opposite forward part 134. Additionally, aft part 136 may be formed axially adjacent and/or axially downstream of central part 132. In the non-limiting example shown in FIG. 6, each of the parts 132, 134, 136 of first cooling passage 130 may include distinct sizes, and more specifically, radial-opening heights. Specifically, central part 132 of first cooling passage 130 may include a first radial-opening height, forward part 134 may include a second radial-opening height, and aft part 136 may include a third radial-opening height. The third radial-opening height of aft part 136 of first cooling passage 130 may be larger than the first radial-opening height of central part 132, and the second radial-opening height of forward part 134 of first cooling passage 130 may be larger than the third radial-opening height of aft part 136. The size (e.g., radial-opening height) of first cooling passage 130, and its various parts 132, 134, 136, may be dependent on a variety of factors including, but not limited to, the size of turbine shroud 100, the thickness of base portion 126 and/or impingement portion 128, the cooling demand for turbine shroud 100, a desired cooling flow volume/rate to forward part 134/aft part 136 (and additional cooling passages discussed herein, and/or the geometry or shape of forward end 108 and/or aft end 110 of turbine shroud 100. In the non-limiting example of FIG. 6, the second radial-opening height of forward part 134 may be larger than the remaining parts 132, 136 of first cooling passage 130 as a result of the size, shape, and/or geometry of unitary body 106 for turbine shroud 100 at forward end 108 and/or the size, shape, and/or geometry of first hook 102 of turbine shroud 100. Additionally, the radial-opening height for each of the parts 132, 134, 136 of first cooling passage 130 formed in turbine shroud 130 may vary within a single turbine shroud.

In order to provide first cooling passage 130 with cooling fluid, turbine shroud 100 may also include a plurality of impingement openings 138 formed therethrough. That is, and as shown in FIG. 6, turbine shroud 100 may include a plurality of impingement openings 138 formed through outer surface 120, and more specifically impingement portion 128, of unitary body 106. The plurality of impingement openings 138 formed through outer surface 120 and/or impingement portion 128 may fluidly couple cooling chamber 122 and first cooling passage 130. As discussed herein, during operation of gas turbine system 10 (see, FIG. 1) cooling fluid flowing through cooling chamber 122 may pass or flow through the plurality of impingement openings 138 to first cooling passage 130 to substantially cool turbine shroud 100.

It is understood that the size and/or number of impingement openings 138 formed through outer surface 120 and/or impingement portion 128, as shown in FIG. 6, is merely illustrative. As such, turbine shroud 100 may include larger or smaller impingement openings 138, and/or may include more or less impingement openings 138 formed therein. Additionally, although the plurality of impingement openings 138 are shown to be substantially uniform in size and/or shape, it is understood that each of the plurality of impingement openings 138 formed on turbine shroud 100 may include distinct sizes and/or shapes. The size, shapes, and/or number of impingement openings 138 formed in turbine shroud 100 may be dependent, at least in part on the operational characteristics (e.g., exposure temperature, exposure pressure, position within turbine casing 36, and the like) of gas turbine system 10 during operation. Additionally, or alternatively, the size, shapes, and/or number of impingement openings 138 formed in turbine shroud 100 may be dependent, at least in part on the characteristics (e.g., base portion 126 thickness, impingement portion 128 thickness, height of first cooling passage 130, volume of first cooling passage 130, and so on) of turbine shroud 100/first cooling passage 130.

Additionally as shown in FIG. 6, unitary body 106 of turbine shroud 100 may also include a plurality of support pins 140. The plurality of support pins 140 may be positioned within first cooling passage 130. More specifically, each of the plurality of support pins 140 may be positioned within first cooling passage 130, and may extend between and/or be formed integral with base portion 126 and impingement portion 128, respectively, of unitary body 106. In the non-limiting example, the plurality of support pins 140 may be formed and/or positioned within central part 132 of first cooling passage 130. However, it is understood that support pins 140 may be positioned in distinct parts (e.g., forward part 134, aft part 136) of first cooling passage 130 as well. The plurality of support pins 140 may be positioned throughout first cooling passage 130 to provide support, structure, and/or rigidity to both base portion 126 and impingement portion 128. In the non-limiting example discussed herein where both base portion 126 and impingement portion 128 include a thickness that is between approximately 1.25 mm (0.05 in) and approximately 6.35 mm (0.25 in), base portion 126 and impingement portion 128 may vibrate during operation of gas turbine system 10 without additional structure or support. The inclusion of the plurality of support pins 140 extending between and/or be formed integral with base portion 126 and impingement portion 128, provides additional support, structure, and/or rigidity to both base portion 126 and impingement portion 128, and may substantially prevent vibration of base portion 126 and impingement portion 128 during operation of gas turbine system 10. In addition to providing support, structure, and/or rigidity to both base portion 126 and impingement portion 128, the plurality of support pins 140 positioned within first cooling passage 130 may also aid in the heat transfer and/or cooling of turbine shroud 100 during operation of gas turbine system 10 (see, FIG. 1), as discussed herein. That is, and as discussed herein, the plurality of support pins 140 may be utilized, relied on and/or may provide increased cooling and/or heat transfer in portions of turbine shroud 100 (e.g., forward part 134, aft part 136) that may not include or be able to include impingement openings 138. The plurality of support pins 140 may be formed integral with base portion 126 and impingement portion 128 when forming unitary body 106 of turbine shroud 100 using any suitable additive manufacturing process(es) and/or method. In non-limiting examples the plurality of support pins 140 formed within turbine shroud 100 may include a width/diameter that is between approximately 0.75 mm (0.03 in) and approximately 2.54 mm (0.10 in).

The size, shape, and/or number of support pins 140 positioned within first cooling passage 130, as shown in FIG. 6, is merely illustrative. As such, turbine shroud 100 may include larger of smaller support pins 140, varying sized support pins 140, and/or may include more or less support pins formed therein. Similar to impingement openings 138, the size, shapes, and/or number of support pins 140 formed in turbine shroud 100 may be dependent, at least in part on the operational characteristics (e.g., exposure temperature, exposure pressure, position within turbine casing 36, and the like) of gas turbine system 10 during operation. Additionally, or alternatively, the size, shapes, and/or number of support pins 140 formed in turbine shroud 100 may be dependent, at least in part on the characteristics (e.g., base portion 126 thickness, impingement portion 128 thickness, height of first cooling passage 130, volume of first cooling passage 130, and so on) of turbine shroud 100/first cooling passage 130.

In addition to first cooling passage 130, turbine shroud 100 may also include a second cooling passage 142. Second cooling passage 142 may be formed, positioned, and/or extending within unitary body 106 of turbine shroud 100. That is, and as shown in FIG. 6, second cooling passage 142 may be extend within unitary body 106 of turbine shroud 100 adjacent forward end 108. Second cooling passage 142 may also be formed and/or extend within unitary body 106 between first side 112 and second side 118, respectively, adjacent forward end 108 of unitary body 106. In the non-limiting example, second cooling passage 142 may be formed and/or extend within unitary body 106 adjacent central part 132 and forward part 134 of first cooling passage 130. More specifically, second cooling passage 142 may be positioned adjacent to and upstream of central part 132 of first cooling passage 130, and may also be positioned radially inward from forward part 134 of first cooling passage 130. In the non-limiting example, second cooling passage 142 may also be formed or positioned between forward part 134 of first cooling passage 130 and inner surface 124 and/or base portion 126.

Second cooling passage 142 may also be separated from forward part 134 of first cooling passage 130 by a first rib 144. That is, and as shown in FIG. 6, first rib 144 may be formed between and may separate first cooling passage 130 and second cooling passage 142. First rib 144 may be formed integral with unitary body 106 of turbine shroud 100, and may be formed adjacent forward end 108 of turbine shroud 100. Additionally, first rib 144 may extend within unitary body 106 between first side 112 and second side 118, and may be formed integral with the solid side walls formed on first side 112 and second side 118 of unitary body 106.

Second cooling passage 142 of turbine shroud 100 may also be in fluid communication with and/or fluidly coupled to first cooling passage 130 of turbine shroud 100. For example, unitary body 106 of turbine shroud 100 may include a first plurality of impingement holes 146 formed through first rib 144. The first plurality of impingement holes 146 formed through first rib 144 may fluidly couple first cooling passage 130, and more specifically forward part 134, and second cooling passage 142. As discussed herein, during operation of gas turbine system 10 (see, FIG. 1) cooling fluid flowing through forward part 134 of first cooling passage 130 may pass or flow through the plurality of impingement holes 146 to second cooling passage 142 to substantially cool turbine shroud 100.

The size, shape, and/or number of impingement holes 146 formed through first rib 144, as shown in FIG. 6, is merely illustrative. As such, turbine shroud 100 may include larger of smaller impingement holes 146, varying sized impingement holes 146, and/or may include more or less impingement holes 146 formed therein. Similar to impingement openings 138 formed through outer surface 120/impingement portion 128, the size, shapes, and/or number of impingement holes 146 formed through first rib 144 may be dependent, at least in part on the operational characteristics of gas turbine system 10 during operation, and/or the characteristics of turbine shroud 100/second cooling passage 142.

Similar to first cooling passage 130, second cooling passage 142 may also include a first plurality of support pins 148. That is, unitary body 106 of turbine shroud 100 may include a first plurality of support pins 148 positioned within second cooling passage 142. The first plurality of support pins 148 may extend between and/or may be formed integral with base portion 126 and first rib 144, respectively, of unitary body 106. Similar to support pins 140 positioned within first cooling passage 130, the first plurality of support pins 148 positioned within second cooling passage 142 may provide support, structure, and/or rigidity to both base portion 126 and first rib 144 of unitary body 106, and may also aid in the heat transfer and/or cooling of turbine shroud 100 during operation of gas turbine system 10 (see, FIG. 1). Also similar to support pins 140, the first plurality of support pins 148 may be formed integral with base portion 126 and first rib 144 when forming unitary body 106 of turbine shroud 100 using any suitable additive manufacturing process(es) and/or method. The size, shape, and/or number of the first plurality of support pins 148 positioned within second cooling passage 142 is merely illustrative, and may be dependent, at least in part on the operational characteristics of gas turbine system 10 during operation, and/or the characteristics of turbine shroud 100/second cooling passage 142.

Also shown in FIG. 6, turbine shroud 100 may include a first exhaust hole 150. First exhaust hole 150 may be in fluid communication with second cooling passage 142. More specifically, first exhaust hole 150 may be in fluid communication with and may extend axially from second cooling passage 142 of turbine shroud 100. In the non-limiting example shown in FIG. 6, first exhaust hole 150 may extend through unitary body 106, from second cooling passage 142 to forward end 108 of turbine shroud 100. In addition to being in fluid communication with second cooling passage 142, first exhaust hole 150 may be in fluid communication with the hot gas flow path (FP) for turbine 28 (see, FIG. 2). As such, first exhaust hole 150 may fluidly couple second cooling passage 142 and the hot gas flow path (FP) for turbine 28. During operation, and as discussed herein, first exhaust hole 150 may discharge cooling fluid from second cooling passage 142, adjacent forward end 108 of turbine shroud 100, and into the hot gas flow path (FP) of combustion gases 26 flowing through turbine 28. Although a single exhaust hole is shown in FIG. 6, it is understood that unitary body 106 of turbine shroud may include a plurality of first exhaust holes 150 formed therein, and in fluid communication with second cooling passage 142. Additionally, although shown as being substantially round/circular and linear, it is understood that first exhaust hole(s) 150 may be non-round and/or non-linear openings, channels and/or manifolds. Where first exhaust hole(s) 150 are formed to be non-round and/or non-linear, the direction of flow of the cooling fluid may vary to improve the cooling of forward end 108 of turbine shroud 100.

Also in the non-limiting example shown in FIG. 6, turbine shroud 100 may also include a third cooling passage 152. Third cooling passage 152 may be formed, positioned, and/or extending within unitary body 106 of turbine shroud 100. That is, third cooling passage 152 may be extend within unitary body 106 of turbine shroud 100 adjacent aft end 110. Third cooling passage 152 may also be formed and/or extend within unitary body 106 between first side 112 and second side 118, respectively, adjacent aft end 110 of unitary body 106. In the non-limiting example, third cooling passage 152 may be formed and/or extend within unitary body 106 adjacent central part 132 and aft part 136 of first cooling passage 130. More specifically, third cooling passage 152 may be positioned adjacent to and downstream of central part 132 of first cooling passage 130, and may also be positioned radially inward from aft part 136 of first cooling passage 130. In the non-limiting example, third cooling passage 152 may also be formed or positioned between aft part 136 of first cooling passage 130 and inner surface 124 and/or base portion 126.

Third cooling passage 152 may also be separated from aft part 136 of first cooling passage 130 by a second rib 154. That is, and as shown in FIG. 6, second rib 154 may be formed between and may separate first cooling passage 130 and third cooling passage 152. Second rib 154 may be formed integral with unitary body 106 of turbine shroud 100, and may be formed adjacent aft end 110 of turbine shroud 100. Additionally, second rib 154 may extend within unitary body 106 between first side 112 and second side 118, and may be formed integral with the solid side walls formed on first side 112 and second side 118 of unitary body 106.

Third cooling passage 152 of turbine shroud 100 may also be in fluid communication with and/or fluidly coupled to first cooling passage 130 of turbine shroud 100. For example, unitary body 106 of turbine shroud 100 may include a second plurality of impingement holes 156 formed through second rib 154. The second plurality of impingement holes 156 formed through second rib 154 may fluidly couple first cooling passage 130, and more specifically aft part 136, and third cooling passage 152. As discussed herein, during operation of gas turbine system 10 (see, FIG. 1) cooling fluid flowing through aft part 136 of first cooling passage 130 may pass or flow through the second plurality of impingement holes 156 to third cooling passage 152 to substantially cool turbine shroud 100. Similar to the first plurality of impingement holes 146, the size, shape, and/or number of impingement holes 156 formed through second rib 154, as shown in FIG. 6, is merely illustrative, and may be dependent, at least in part, on the operational characteristics of gas turbine system 10 during operation, and/or the characteristics of turbine shroud 100/third cooling passage 152.

Similar to first cooling passage 130, third cooling passage 152 may also include a second plurality of support pins 158. That is, unitary body 106 of turbine shroud 100 may include a second plurality of support pins 158 positioned within third cooling passage 152. The second plurality of support pins 158 may extend between and/or may be formed integral with base portion 126 and second rib 154, respectively, of unitary body 106. Similar to the first plurality of support pins 148 positioned within second cooling passage 142, the second plurality of support pins 158 positioned within third cooling passage 152 may provide support, structure, and/or rigidity to both base portion 126 and second rib 154 of unitary body 106, and may also aid in the heat transfer and/or cooling of turbine shroud 100 during operation of gas turbine system 10 (see, FIG. 1). Also similar to the first plurality of support pins 148, the second plurality of support pins 158 may be formed integral with base portion 126 and second rib 154 when forming unitary body 106 of turbine shroud 100 using any suitable additive manufacturing process(es) and/or method. The size, shape, and/or number of the second plurality of support pins 158 positioned within third cooling passage 152 is merely illustrative, and may be dependent, at least in part, on the operational characteristics of gas turbine system 10 during operation, and/or the characteristics of turbine shroud 100/third cooling passage 152.

Also shown in FIG. 6, turbine shroud 100 may include a second exhaust hole 160. Second exhaust hole 160 may be in fluid communication with third cooling passage 152. More specifically, second exhaust hole 160 may be in fluid communication with and may extend from third cooling passage 152 of turbine shroud 100. As shown in FIG. 6, second exhaust hole 160 may extend axially through unitary body 106, from third cooling passage 152 to aft end 110 of turbine shroud 100. Similar to first exhaust hole 150, second exhaust hole 160 may also be in fluid communication with the hot gas flow path (FP) for turbine 28 (see, FIG. 2). As such, second exhaust hole 160 may fluidly couple third cooling passage 152 and the hot gas flow path (FP) for turbine 28. As discussed herein, second exhaust hole 160 may discharge cooling fluid from third cooling passage 152, adjacent aft end 110 of turbine shroud 100, and into the hot gas flow path (FP) of combustion gases 26 flowing through turbine 28. Although a single exhaust hole is shown in FIG. 6, it is understood that unitary body 106 of turbine shroud may include a plurality of second exhaust holes 160 formed therein, and in fluid communication with third cooling passage 152. Additionally, although shown as being substantially round/circular and linear, it is understood that second exhaust hole(s) 160 may be non-round and/or non-linear openings, channels and/or manifolds. Where second exhaust hole(s) 160 are formed to be non-round and/or non-linear, the direction of flow of the cooling fluid may vary to improve the cooling of aft end 110 of turbine shroud 100.

During operation of gas turbine system 10 (see, FIG. 1), cooling fluid (CF) may flow through unitary body 106 to cool turbine shroud 100. More specifically, as turbine shroud 100 is exposed to combustion gases 26 flowing through the hot gas flow path of turbine 28 (see, FIG. 2) during operation of gas turbine system 10 and increases in temperature, cooling fluid (CF) may be provided to and/or may flow through the plurality of cooling passages 130, 142, 152 formed and/or extending through unitary body 106 to cool turbine shroud 100. With respect to FIG. 6, the various arrows may represent and/or may illustrates the flow path of the cooling fluid (CF) as it flows through the unitary body 106 of turbine shroud 100. In a non-limiting example, cooling fluid (CF) may first flow from cooling chamber 122 to first cooling passage 130 via the plurality of impingement openings 138 formed through outer surface 120 and/or impingement portion 128 of unitary body 106. The cooling fluid (CF) may initially enter central part 132 of first cooling passage 130. The cooling fluid (CF) flowing into/through central part 132 of first cooling passage 130 may cool and/or receive heat from outer surface 120/impingement portion 128 and/or inner surface 124/base portion 126. Additionally, the plurality of support pins 140 positioned within first cooling passage 130 may receive and/or dissipate some of the heat from outer surface 120/impingement portion 128 and/or inner surface 124/base portion 126. Once inside first cooling passage 130, the cooling fluid (CF) may be dispersed and/or may flow axially toward one of forward end 108 or aft end 110 of unitary body 106 for turbine shroud 100. More specifically, the cooling fluid (CF) in central part 132 of first cooling passage 130 may flow axially into forward part 134 of first cooling passage 130 or aft part 136 of first cooling passage 130. The cooling fluid (CF) may flow to the respect part 134, 136 of first cooling passage 130 and/or end 108, 110 of turbine shroud 100 as a result of, for example, the internal pressure within first cooling passage 130.

Once the cooling fluid (CF) has flowed to the respect part 134, 136 of first cooling passage 130 and/or end 108, 110 of turbine shroud 100, the cooling fluid (CF) may flow to distinct cooling passages 142, 152 formed and/or extending within unitary body 106 of turbine shroud 100 to continue to cool turbine shroud 100 and/or receive heat. For example, the portion of cooling fluid (CF) that flows to forward end 108 and/or forward part 134 of first cooling passage 130 may subsequently flow to second cooling passage 142. The cooling fluid (CF) may flow from forward part 134 of first cooling passage 130 to second cooling passage 142 via the first plurality of impingement holes 146 formed through first rib 144 of unitary body 106. Once inside second cooling passage 142, the cooling fluid (CF), along with the first plurality of support pins 148 positioned with second cooling passage 142, may continue to cool turbine shroud 100 and/or receive/dissipate heat from turbine shroud 100. From second cooling passage 142, the cooling fluid (CF) may flow through first exhaust hole 150, exhaust adjacent forward end 108, and into the hot gas flow path of combustion gases 26 flowing through turbine 28 (see, FIG. 2).

Simultaneously, the distinct portion of cooling fluid (CF) that flows to aft end 110 and/or aft part 136 of first cooling passage 130 may subsequently flow to third cooling passage 152. The cooling fluid (CF) may flow from aft part 136 of first cooling passage 130 to third cooling passage 152 via the second plurality of impingement holes 156 formed through second rib 154 of unitary body 106. Once inside third cooling passage 152, the cooling fluid (CF), along with the second plurality of support pins 158 positioned with third cooling passage 152, may continue to cool turbine shroud 100 and/or receive/dissipate heat from turbine shroud 100. The cooling fluid (CF) may then flow through second exhaust hole 160, exhaust adjacent aft end 110, and finally flow into the hot gas flow path of combustion gases 26 flowing through turbine 28 (see, FIG. 2).

Figure 7:
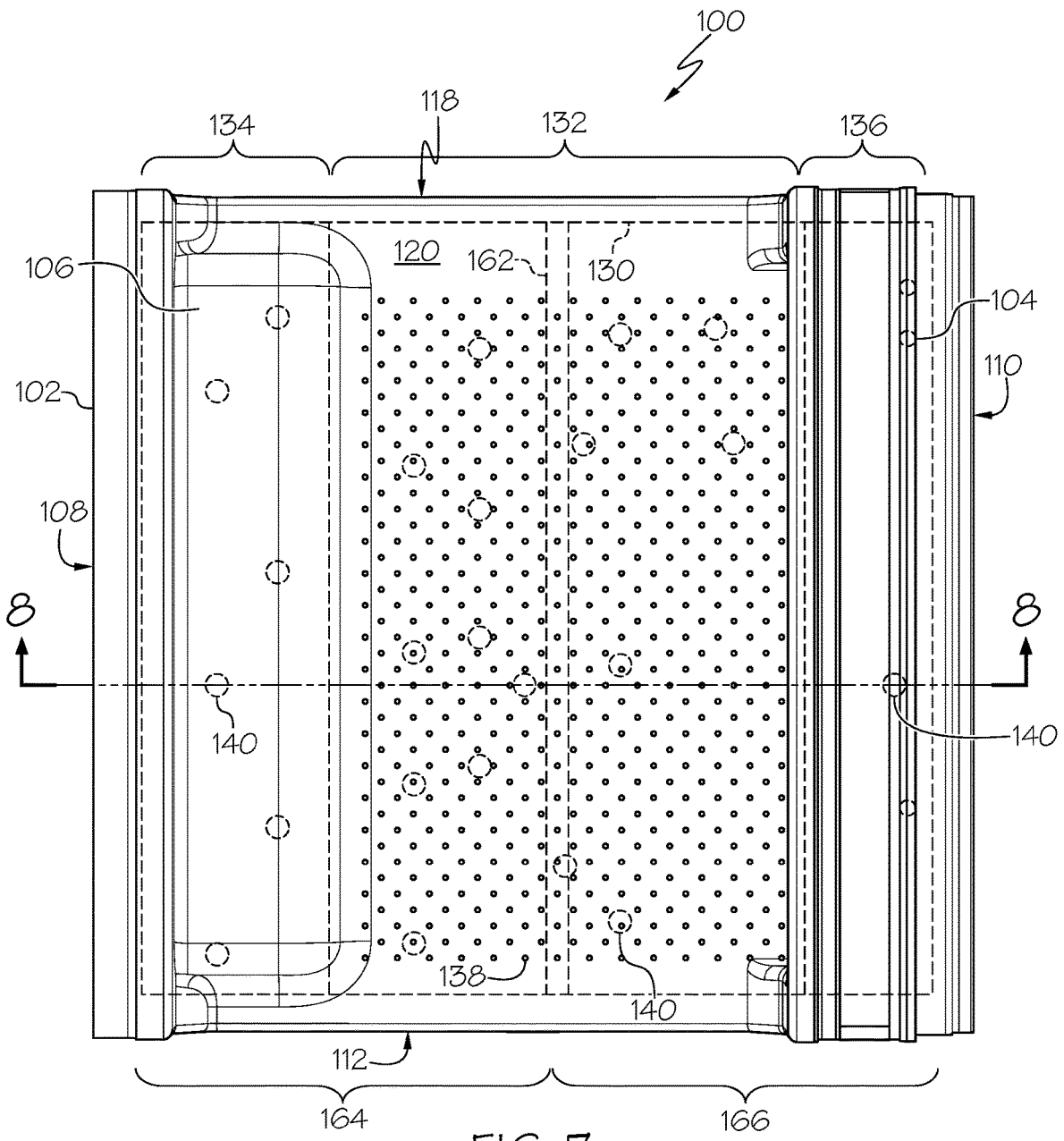
FIG. 7 shows a top view of a turbine shroud including a cooling passage wall, according to additional embodiments of the disclosure.
Figure 8:
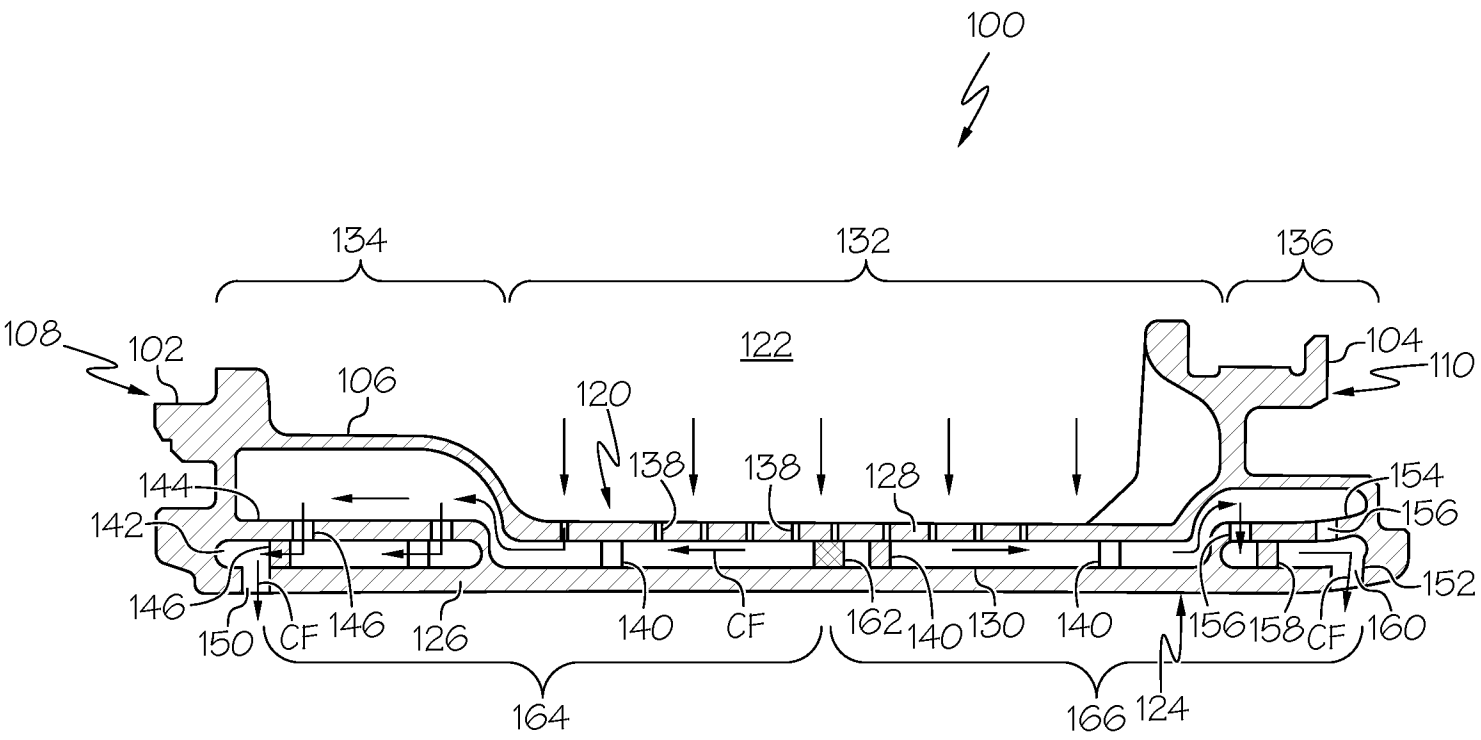
FIG. 8 shows a cross-sectional side view of the turbine shroud taken along line 8-8 in FIG. 7, according to additional embodiments of the disclosure.

FIGS. 7 and 8 show various views of another non-limiting example of turbine shroud 100 of turbine 28 for gas turbine system 10 of FIG. 1. Specifically, FIG. 7 shows a top view of turbine shroud 100, and FIG. 8 shows a cross-sectional side view of turbine shroud 100. It is understood that similarly numbered and/or named components may function in a substantially similar fashion. Redundant explanation of these components has been omitted for clarity.

Turbine shroud 100 shown in FIGS. 7 and 8 may include first exhaust hole 150 and second exhaust hole 160 formed through distinct portions of unitary body 106 compared to the non-limiting example of FIGS. 3-6. For example, and with reference to FIG. 8, first exhaust hole 150 may be in fluid communication with and may extend from second cooling passage 142 of turbine shroud 100, and through base portion 126. Although still positioned substantially adjacent forward end 108, first exhaust hole 150 may extend generally radially through and/or exhaust cooling fluid (CF) through base portion 126 of unitary body 106. Additionally, and as shown in FIG. 8, second exhaust hole 160 may be in fluid communication with and may extend generally radially from third cooling passage 152, and through base portion 126. Second exhaust hole 160 may be positioned substantially adjacent aft end 110, but similar to first exhaust hole 150, may extend through and/or exhaust cooling fluid (CF) from third cooling passage 152 through base portion 126 of unitary body 106. Both first exhaust hole 150 and second exhaust hole 160 may exhaust cooling fluid (CF) into the hot gas flow path of combustion gases 26 flowing through turbine 28 (see, FIG. 2).

Turbine shroud 100 shown in FIGS. 7 and 8 may also include additional features. For example, turbine shroud 100 may include a first cooling passage wall 162. First cooling passage wall 162 (shown in phantom in FIG. 7) may be included and/or formed in first cooling passage 130, and may extend between first side 112 and second side 118 of unitary body 106 for turbine shroud 100. Additionally, and as shown in FIG. 7, first cooling passage wall 162 may extend within first cooling passage 130 substantially parallel to forward end 108 and aft end 110. Continuing the non-limiting example shown in FIG. 8, first cooling passage wall 162 may be formed in central part 132 of first cooling passage 130, and may extend between and/or may be formed integral with base portion 126 and impingement portion 128, respectively, of unitary body 106. First cooling passage wall 162 may be formed integral with base portion 126 and impingement portion 128 when forming unitary body 106 of turbine shroud 100 using any suitable additive manufacturing process(es) and/or method.

First cooling passage wall 162 may be formed in first cooling passage 130 to aid in the heat transfer and/or cooling of turbine shroud 100 during operation of gas turbine system 10 (see, FIG. 1), as similarly discussed herein with respect to the plurality of support pins 140 positioned within first cooling passage 130. Additionally, or alternatively, first cooling passage wall 162 may be formed in first cooling passage 130 to divide first cooling passage 130, and/or to aid in directing the cooling fluid (CF) to the respect parts 134, 136 of first cooling passage 130 and/or ends 108, 110 of turbine shroud 100 during the cooling process discussed herein. That is, first cooling passage wall 162 may substantially divide first cooling passage 130 into a forward section 164 and an aft section 166. Forward section 164 of first cooling passage 130 may be formed between forward end 108 of unitary body 106 and first cooling passage wall 162. Forward section 164 may also include a portion of central part 132 of first cooling passage 130, as well as forward part 134. Additionally, aft section 166 of first cooling passage 130 may be formed between aft end 110 of unitary body 106 and first cooling passage wall 162. Aft section 166 may include a distinct or remaining portion of central part 132 of first cooling passage 130, as well as aft part 136. By forming forward section 164 and aft section 166 in first cooling passage 130, first cooling passage wall 162 may ensure that the cooling fluid (CF) is divided within first cooling passage 130. Additionally, forming first cooling passage wall 162 within first cooling passage 130 may ensure desired portions of the cooling fluid (CF) flows through the respective forward section 164 and aft section 166 to second cooling passage 142 and third cooling passage 152, respectively, as similarly discussed herein.

Figure 9:
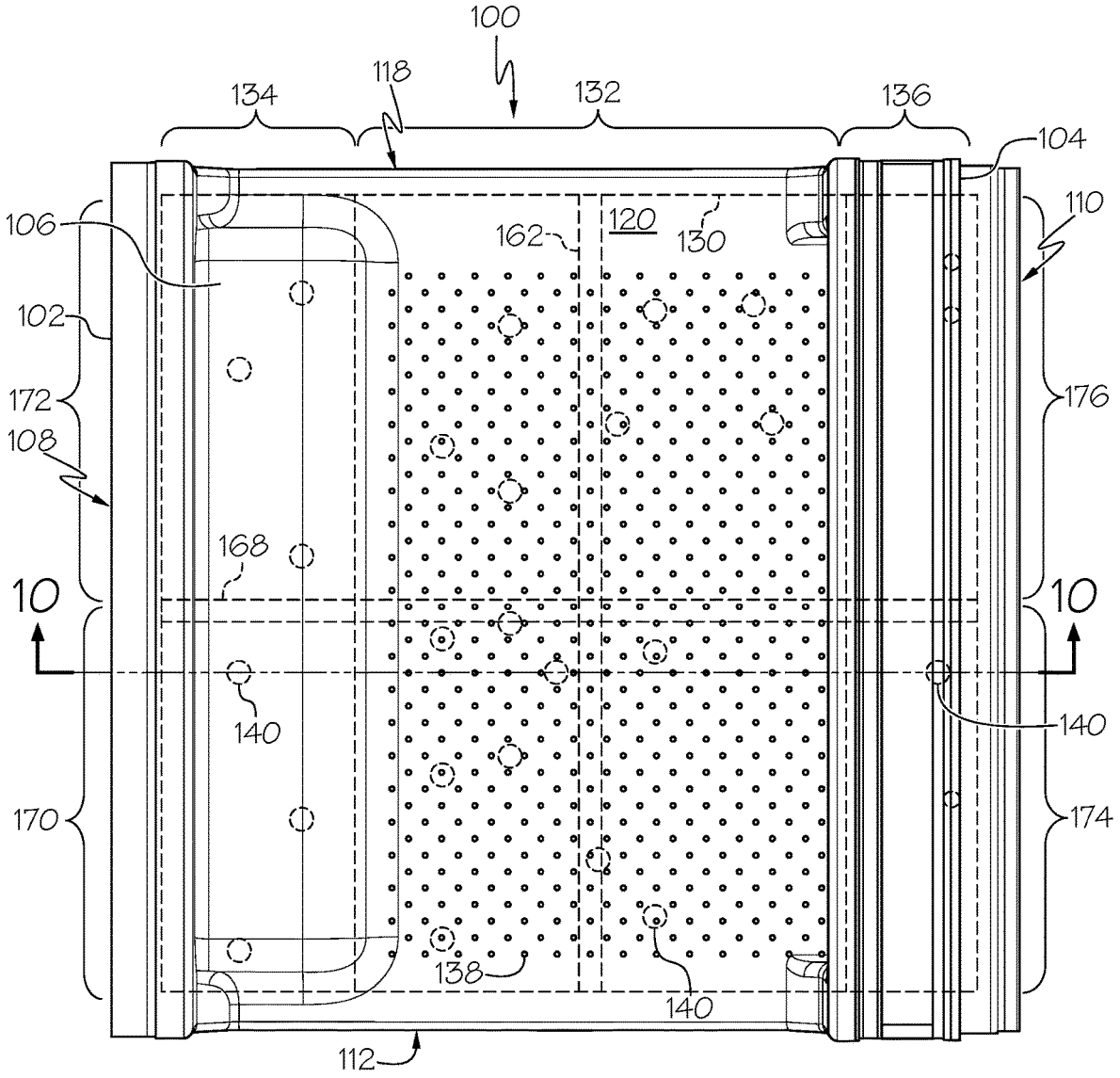
FIG. 9 shows a top view of a turbine shroud including two cooling passage walls, according to further embodiments of the disclosure.
Figure 10:
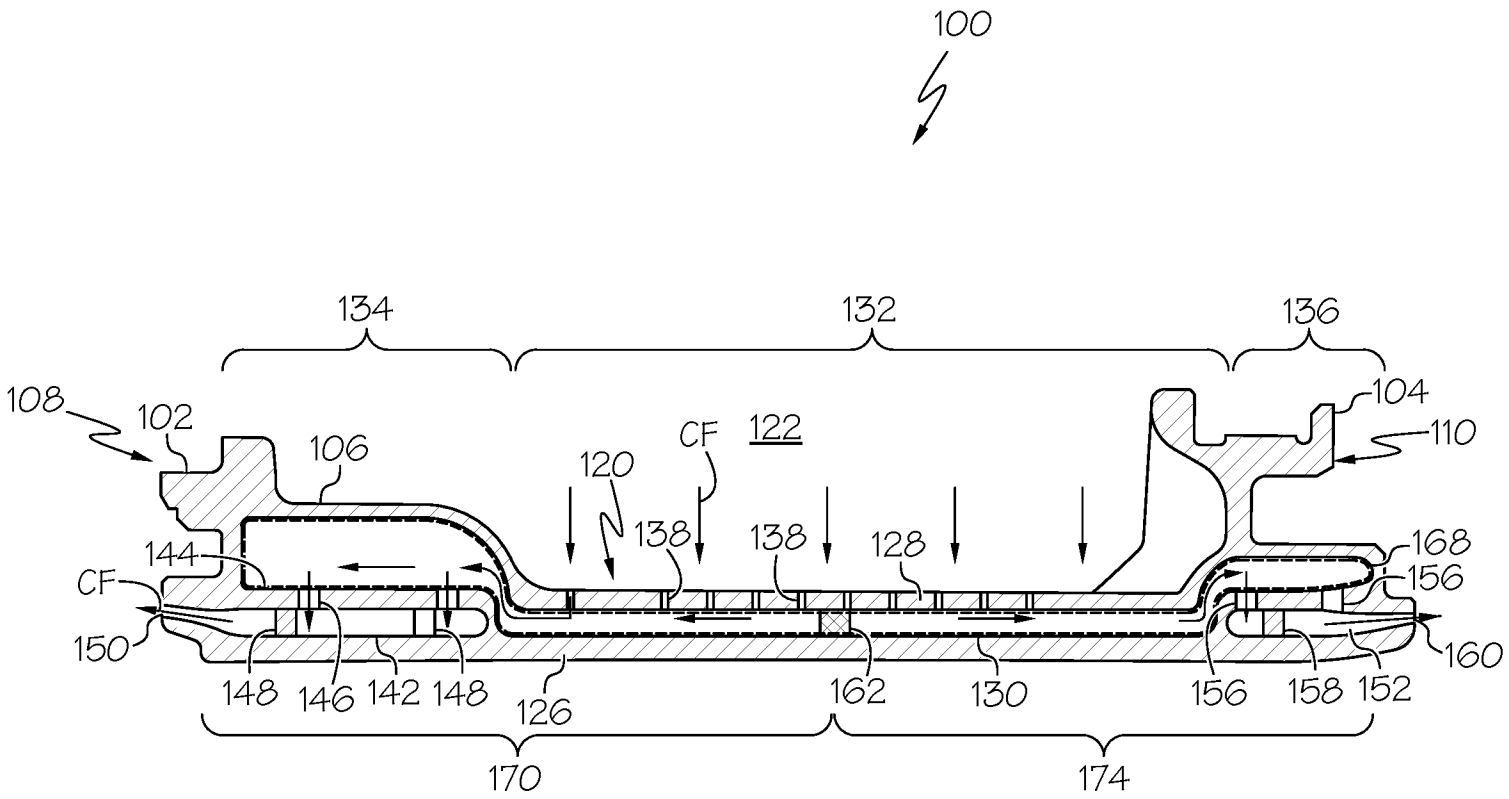
FIG. 10 shows a cross-sectional side view of the turbine shroud taken along line 10-10 in FIG. 9, according to further embodiments of the disclosure.

FIGS. 9 and 10 show various views of an additional non-limiting example of turbine shroud 100 of turbine 28 for gas turbine system 10 of FIG. 1. Specifically, FIG. 9 shows a top view of turbine shroud 100, and FIG. 10 shows a cross-sectional side view of turbine shroud 100. It is understood that similarly numbered and/or named components may function in a substantially similar fashion. Redundant explanation of these components has been omitted for clarity.

In the non-limiting examples shown in FIGS. 9 and 10 turbine shroud 100 may also include a second cooling passage wall 168. Second cooling passage wall 168 (shown in phantom in FIG. 9) may be included and/or formed in first cooling passage 130, and may extend axially between forward end 108 and aft end 110 of unitary body 106 for turbine shroud 100, substantially parallel to first side 112 and second side 118. Additionally, second cooling passage wall 168 may extend within first cooling passage 130 substantially perpendicular to first cooling passage wall 162. Turning to FIG. 10, and similar to first cooling passage wall 162, second cooling passage wall 168 may extend between and/or may be formed integral with base portion 126 and impingement portion 128, respectively, of unitary body 106. Second cooling passage wall 168 may be formed integral with base portion 126 and impingement portion 128 when forming unitary body 106 of turbine shroud 100 using any suitable additive manufacturing process(es) and/or method. Second cooling passage wall 168 shown in FIG. 10 may also be formed in and/or extend through central part 132, forward part 134, and aft part 136 of first cooling passage 130.

Second cooling passage wall 168 may also be formed in first cooling passage 130 to aid in the heat transfer and/or cooling of turbine shroud 100 during operation of gas turbine system 10 (see, FIG. 1), as similarly discussed herein with respect to the plurality of support pins 140 positioned within first cooling passage 130 and/or first cooling passage wall 162. Additionally, or alternatively, second cooling passage wall 168, along with first cooling passage wall 162, may be formed in first cooling passage 130 to divide first cooling passage 130, and/or to aid in directing the cooling fluid (CF) within first cooling passage 130 as similarly discussed herein with respect to FIGS. 7 and 8. For example, first cooling passage wall 162 and second cooling passage wall 168 may substantially divide first cooling passage 130 into a first forward section 170, a second forward section 172, a first aft section 174, and a second aft section 176. First forward section 170 of first cooling passage 130 may be formed between forward end 108 of unitary body 106 and first cooling passage wall 162, and first side 112 and second cooling passage wall 168. Second forward section 172 of first cooling passage 130 may be formed between forward end 108 and first cooling passage wall 162, as well as second side 118 and second cooling passage wall 168. First forward section 170 and second forward section 172 may each also include distinct portions of central part 132 of first cooling passage 130, as well as a distinct portion of forward part 134. Additionally, first aft section 174 of first cooling passage 130 may be formed between aft end 110 of unitary body 106 and first cooling passage wall 162, as well as first side 112 and second cooling passage wall 168. Second aft section 176 of first cooling passage 130 may be formed between aft end 110 of unitary body 106 and first cooling passage wall 162, and second side 118 and second cooling passage wall 168. First aft section 174 and second aft section 176 may each include distinct, remaining portions of central part 132 of first cooling passage 130, as well as distinct portions of aft part 136. As similarly discussed herein with respect to FIGS. 7 and 8, by forming first forward section 170, second forward section 172, first aft section 174, and second aft section 176 in first cooling passage 130, first cooling passage wall 162 and second cooling passage wall 168 may ensure that the cooling fluid (CF) is divided within first cooling passage 130 during operation of gas turbine system 10 (see, FIG. 1).

Figure 11:
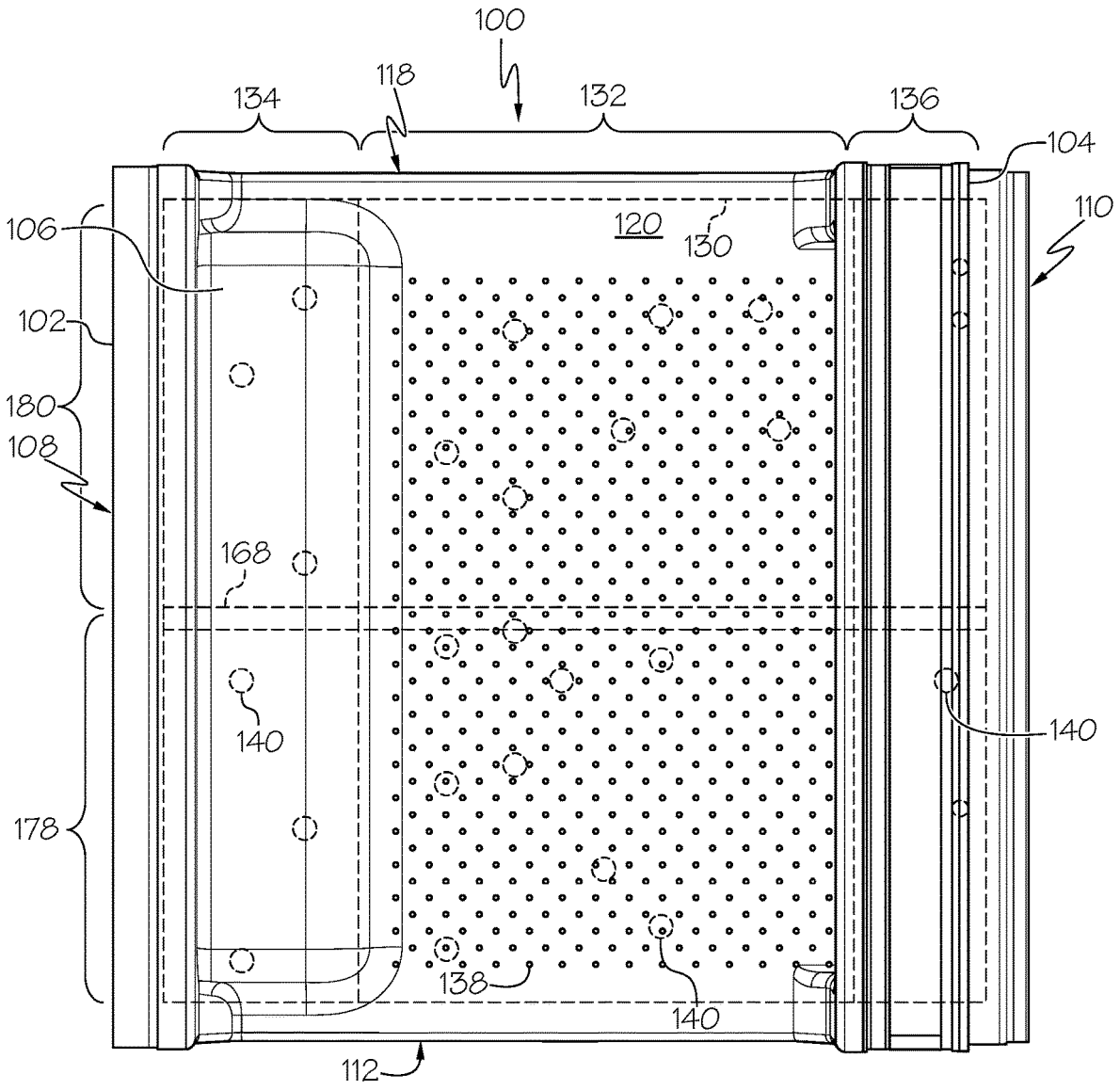
FIG. 11 shows a top view of a turbine shroud including two cooling passage walls, according to another embodiment of the disclosure.

FIG. 11 shows a top view of another non-limiting example of turbine shroud 100. In the non-limiting example shown in FIG. 11 turbine shroud 100 may only include second cooling passage wall 168. That is, turbine shroud 100 may include second cooling passage wall 168, but not first cooling passage wall 162. As similarly discussed herein with respect to FIGS. 9 and 10, second cooling passage wall 168 (shown in phantom in FIG. 11) may be included and/or formed in first cooling passage 130. Second cooling passage wall 168 may extend axially between forward end 108 and aft end 110 of unitary body 106 for turbine shroud 100, and substantially parallel to first side 112 and second side 118. Additionally, and as discussed herein, second cooling passage wall 168 may extend between and/or may be formed integral with base portion 126 and impingement portion 128, respectively, of unitary body 106, and may be formed in and/or extend through central part 132, forward part 134, and aft part 136 of first cooling passage 130 (see, FIG. 10).

As discussed herein with respect to FIGS. 9 and 10, second cooling passage wall 168 may be formed in first cooling passage 130 to aid in the heat transfer and/or cooling of turbine shroud 100 during operation of gas turbine system 10 (see, FIG. 1), and/or to aid in directing the cooling fluid (CF) within first cooling passage 130. For example, second cooling passage wall 168 may substantially divide first cooling passage 130 into a first side section 178, and a second side section 180. First side section 178 of first cooling passage 130 may be formed between forward end 108 and aft end 110 of unitary body 106, and first side 112 and second cooling passage wall 168. Second side section 180 of first cooling passage 130 may be formed between forward end 108 and aft end 110 of unitary body 106, as well as second side 118 and second cooling passage wall 168. Both first side section 178 and second side section 180 may each include distinct portions of central part 132, forward part 134, and aft part 136 of first cooling passage 130, as well as a distinct portion of forward part 134. As similarly discussed herein, by forming first side section 178, and second side section 180 in first cooling passage 130, second cooling passage wall 168 may ensure that the cooling fluid (CF) is divided within first cooling passage 130 during operation of gas turbine system 10 (see, FIG. 1).

Figure 12:
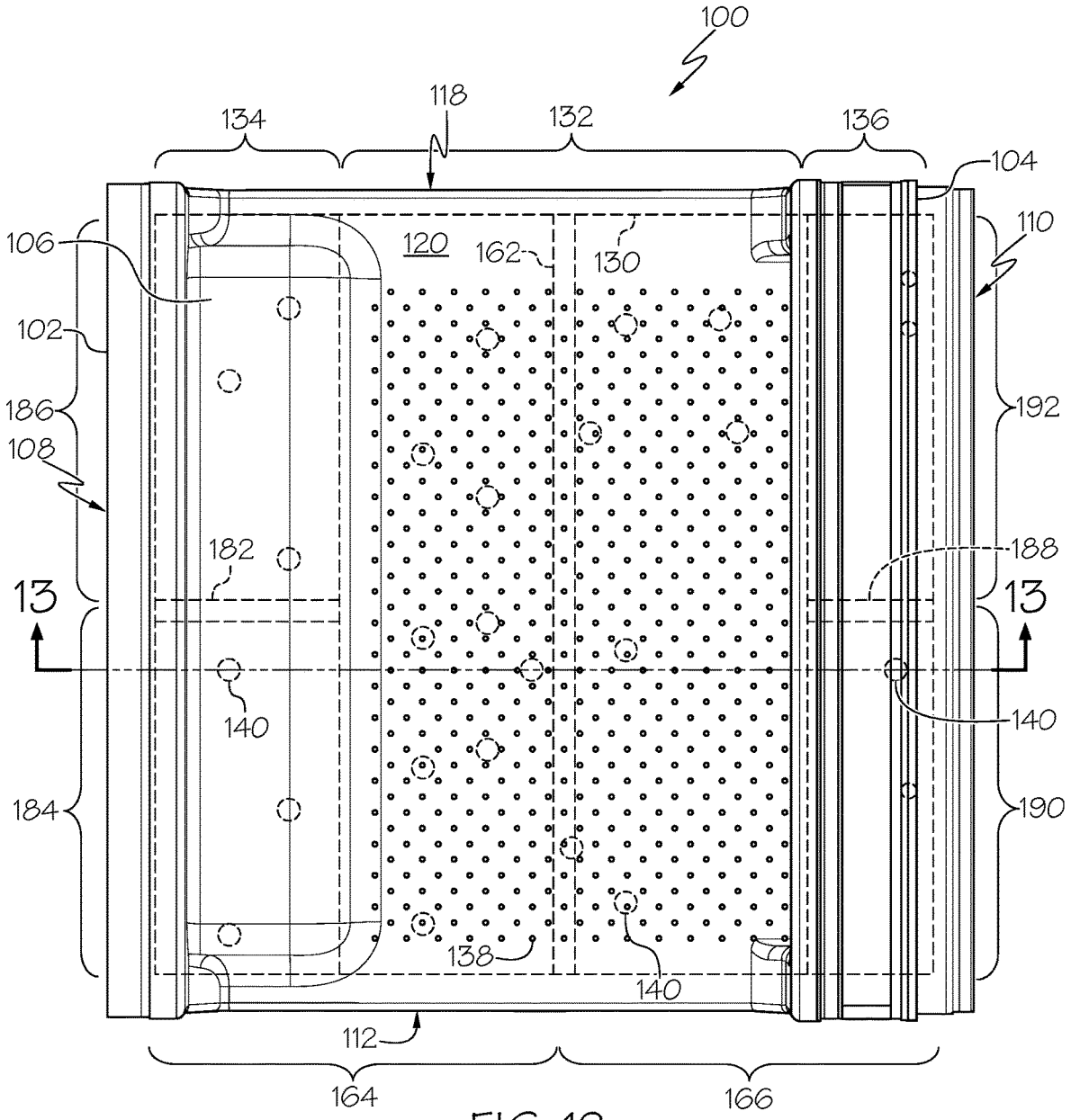
FIG. 12 shows a top view of a turbine shroud including a cooling passage wall, according to further embodiments of the disclosure.
Figure 13:
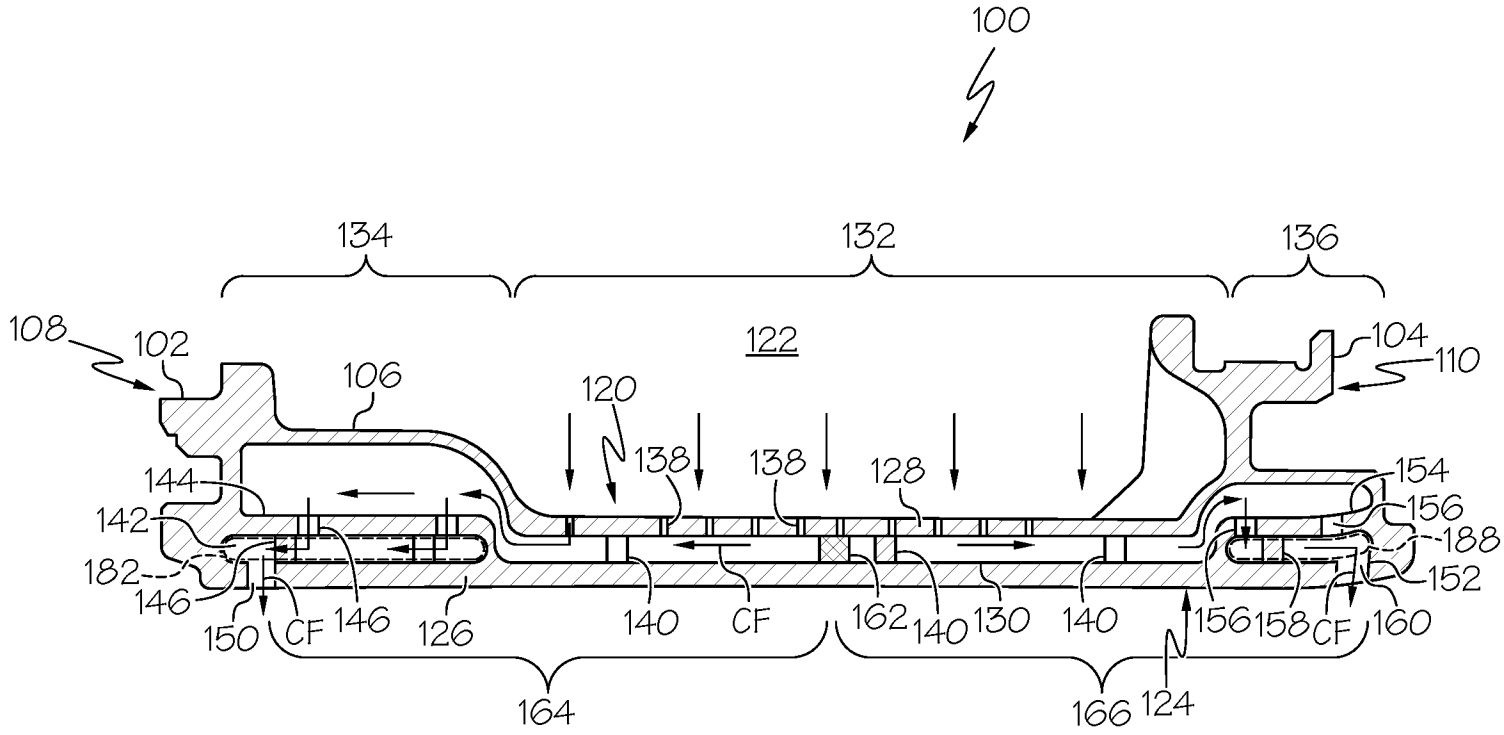
FIG. 13 shows a cross-sectional side view of the turbine shroud taken along line 13-13 in FIG. 12, according to further embodiments of the disclosure.

FIGS. 12 and 13 show various views of another non-limiting example of turbine shroud 100 of turbine 28 for gas turbine system 10 of FIG. 1. Specifically, FIG. 12 shows a top view of turbine shroud 100, and FIG. 13 shows a cross-sectional side view of turbine shroud 100 shown in FIG. 12. Similar to the non-limiting example shown in FIGS. 7 and 8, turbine shroud 100 of FIGS. 12 and 13 may include a first cooling passage wall 162 formed in first cooling passage 130, and extending between first side 112 and second side 118 of unitary body 106. Additionally in the non-limiting example shown in FIGS. 12 and 13, second cooling passage 142 may also include a third cooling passage walls 182. Third cooling passage wall 182 (shown in phantom in FIG. 12) may be included and/or formed in second cooling passage 142, and may extend axially from forward end 108 of unitary body 106 for turbine shroud 100. Additionally, third cooling passage wall 182 may extend within second cooling passage 142 substantially parallel to first side 112 and second side 118 of unitary body 106 for turbine shroud 100. Continuing the non-limiting example shown in FIG. 13, third cooling passage wall 182 may be formed and/or may extend between and/or may be formed integral with base portion 126 and first rib 144, respectively, of unitary body 106. Third cooling passage wall 182 may be formed integral with base portion 126 and first rib 144 when forming unitary body 106 of turbine shroud 100 using any suitable additive manufacturing process(es) and/or method.

Third cooling passage wall 182 may be formed in second cooling passage 142 to aid in the heat transfer and/or cooling of turbine shroud 100 during operation of gas turbine system 10 (see, FIG. 1), as similarly discussed herein with respect to the plurality of support pins 140, 148 positioned within turbine shroud 100. Additionally, or alternatively, third cooling passage wall 182 may be formed in second cooling passage 142 to divide second cooling passage 142, and/or to aid in directing the cooling fluid (CF) through second cooling passage 142 during the cooling process discussed herein. That is, third cooling passage wall 182 may substantially divide second cooling passage 142 into a first section 184 and a second section 186. First section 184 of second cooling passage 142 may be formed between first side 112 of unitary body 106 and third cooling passage wall 182. Second section 186 of second cooling passage 142 may be formed between second side 118 of unitary body 106 and third cooling passage wall 182. As similarly discussed herein, by forming first section 184, and second section 186 in second cooling passage 142, third cooling passage wall 182 may ensure that the cooling fluid (CF) is divided within second cooling passage 142 during operation of gas turbine system 10 (see, FIG. 1).

Similar to second cooling passage 142, third cooling passage 152 may include a fourth cooling passage walls 188. In the non-limiting example shown in FIGS. 12 and 13, fourth cooling passage wall 188 (shown in phantom in FIG. 12) may be included and/or formed in third cooling passage 152, and may extend axially from aft end 110 of unitary body 106 for turbine shroud 100. Additionally, fourth cooling passage wall 188 may extend within third cooling passage 152 substantially parallel to first side 112 and second side 118 of unitary body 106 for turbine shroud 100. Continuing the non-limiting example shown in FIG. 13, fourth cooling passage wall 188 may be formed and/or may extend between and/or may be formed integral with base portion 126 and second rib 154, respectively, of unitary body 106. Fourth cooling passage wall 188 may be formed integral with base portion 126 and second rib 154 when forming unitary body 106 of turbine shroud 100 using any suitable additive manufacturing process(es) and/or method.

Fourth cooling passage wall 188 may be formed in third cooling passage 152 to aid in the heat transfer and/or cooling of turbine shroud 100 during operation of gas turbine system 10 (see, FIG. 1), as similarly discussed herein with respect to the plurality of support pins 140, 158 positioned within turbine shroud 100. Additionally, or alternatively, fourth cooling passage wall 188 may be formed in third cooling passage 152 to divide third cooling passage 152, and/or to aid in directing the cooling fluid (CF) through third cooling passage 152 during the cooling process discussed herein. That is, fourth cooling passage wall 188 may substantially divide third cooling passage 152 into a first section 190 and a second section 192. First section 190 of third cooling passage 152 may be formed between first side 112 of unitary body 106 and fourth cooling passage wall 188. Second section 192 of third cooling passage 152 may be formed between second side 118 of unitary body 106 and fourth cooling passage wall 188. As similarly discussed herein, by forming first section 190, and second section 192 in third cooling passage 152, fourth cooling passage wall 188 may ensure that the cooling fluid (CF) is divided within third cooling passage 152 during operation of gas turbine system 10 (see, FIG. 1).

Although shown as being formed in both second cooling passage 142 and third cooling passage 152, it is understood that cooling passage walls 182, 188 may be formed in only one of second cooling passage 142 or third cooling passage 152. That is in additional non-limiting examples, only second cooling passage 142 may include third cooling passage wall 182, or alternatively, third cooling passage 152 may include fourth cooling passage wall 188. Additionally, although shown in FIGS. 12 and 13 as being formed in turbine shroud 100 that includes only first cooling passage wall 162, cooling passage walls 182, 188 may also be formed turbine shroud 100 that includes both first cooling passage wall 162 and second cooling passage wall 168 (see, FIGS. 9 and 10), or alternatively, just second cooling passage wall 168 (see, FIG. 11).

FIGS. 14-18 show various views of non-limiting examples of turbine shroud 100 of turbine 28 for gas turbine system 10 of FIG. 1. It is understood that similarly numbered and/or named components may function in a substantially similar fashion. Redundant explanation of these components has been omitted for clarity.

Figure 14:
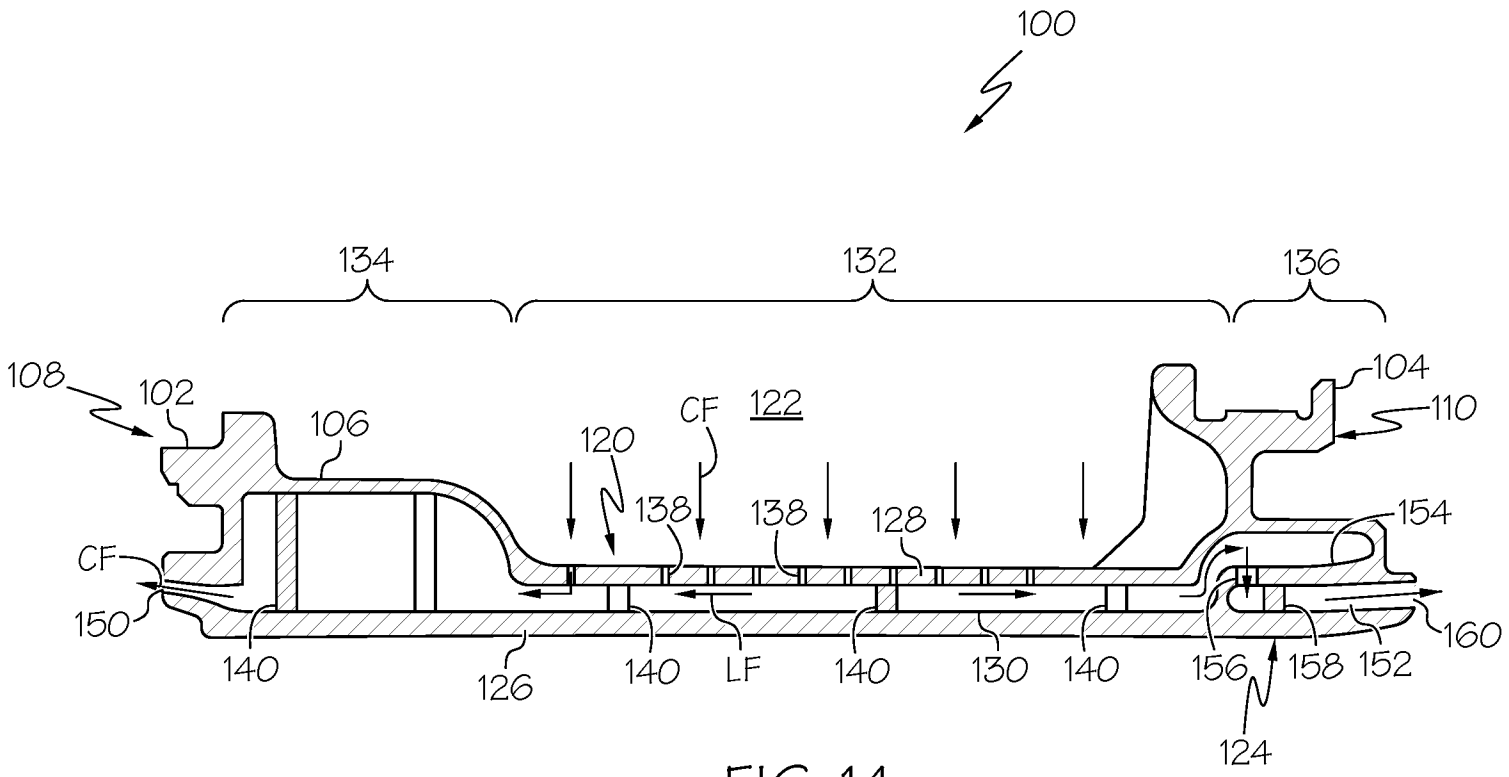
FIG. 14 shows a cross-sectional side view of the turbine shroud of FIG. 4, according to additional embodiments of the disclosure.

Turning to FIG. 14, the non-limiting example of unitary body 106 of turbine shroud 100 may include only first cooling passage 130 and third cooling passage 152. That is, turbine shroud 100 may not include second cooling passage 142 (see, FIG. 6). Unitary body 106 of turbine shroud 100 not including second cooling passage 142 may also not include first rib 144, first plurality of impingement holes 146, and the first plurality of support pins 148, respectively. Rather, and as shown in FIG. 14, forward part 134 of first cooling passage 130 may extend substantially between base portion 126 and impingement portion 128. Additionally in the non-limiting example shown in FIG. 14, first exhaust hole 150 may be in fluid communication with first cooling passage 130, and more specifically forward part 134 of first cooling passage 130, and may extend through unitary body 106 from first cooling passage 130 to forward end 108 of turbine shroud 100.

As similarly discussed herein with respect to central part 132 of first cooling passage 130, a portion of the plurality of support pins 140 may be positioned within forward part 134 and/or may extend between base portion 126 and impingement portion 128 in forward part 134 of first cooling passage 130. The plurality of support pins 140 positioned within forward part 134 may be formed integral with base portion 126 and impingement portion 128 of unitary body 106 to provide support, structure, and/or rigidity, as well as aid in the heat transfer and/or cooling of turbine shroud 100 during operation of gas turbine system 10.

Figure 15:
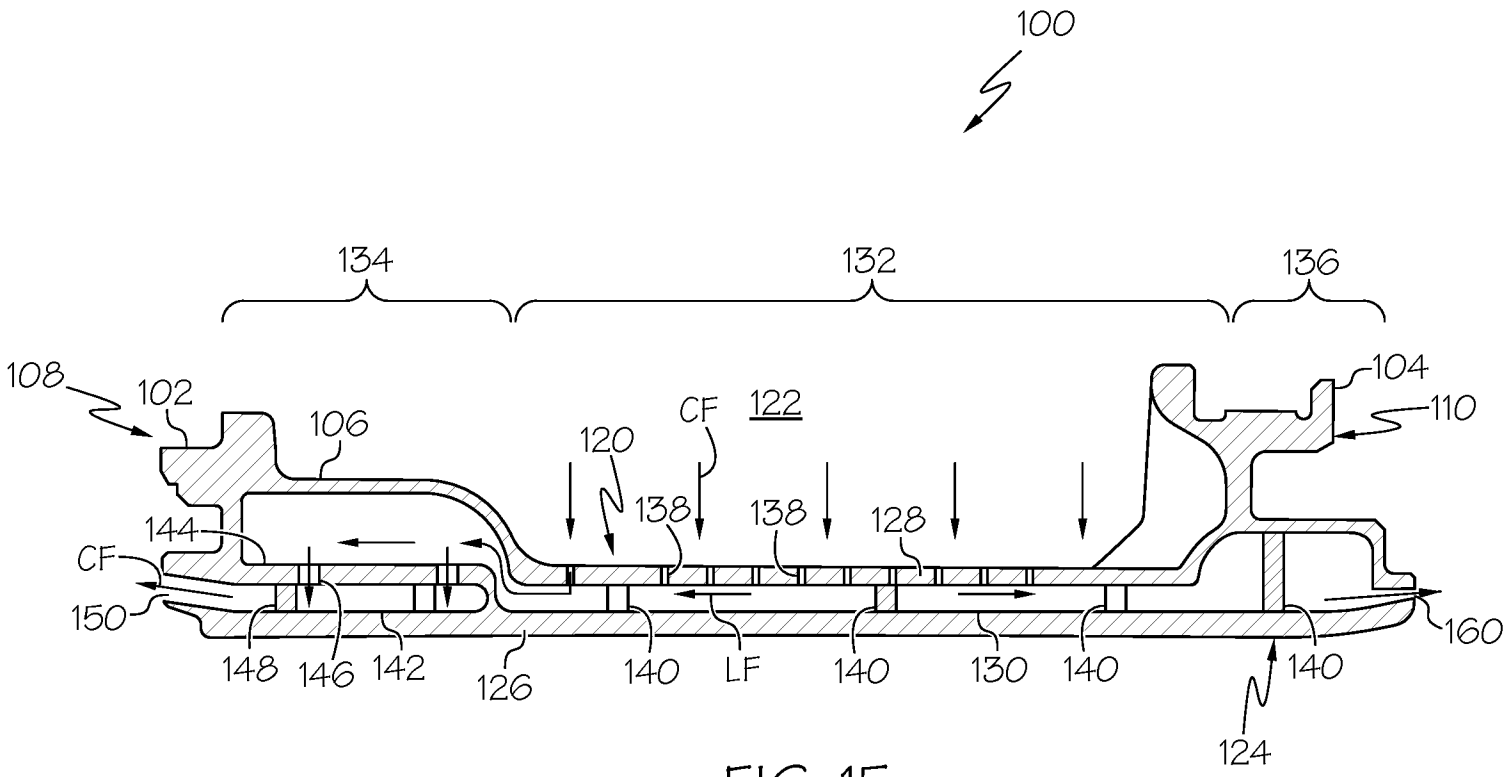
FIG. 15 shows a cross-sectional side view of the turbine shroud of FIG. 4, according to further embodiments of the disclosure.

In the non-limiting example shown in FIG. 15, unitary body 106 of turbine shroud 100 may include only first cooling passage 130 and second cooling passage 142. That is, turbine shroud 100 may not include third cooling passage 152 (see, FIG. 6). As result of not including third cooling passage 152, unitary body 106 of turbine shroud 100 may also not include second rib 154, the second plurality of impingement holes 156, and the second plurality of support pins 158, respectively. As shown in FIG. 15, aft part 136 of first cooling passage 130 may extend substantially between base portion 126 and impingement portion 128. Second exhaust hole 160 may be in fluid communication with first cooling passage 130, and more specifically aft part 136 of first cooling passage 130, and may extend through unitary body 106 from first cooling passage 130 to aft end 110 of turbine shroud 100.

A portion of the plurality of support pins 140 formed and/or positioned within first cooling passage 130 may also be positioned within aft part 136 and/or may extend between base portion 126 and impingement portion 128 in aft part 136 of first cooling passage 130. The plurality of support pins 140 positioned within aft part 136 may be formed integral with base portion 126 and impingement portion 128 of unitary body 106 to provide support, structure, and/or rigidity, as well as aid in the heat transfer and/or cooling of turbine shroud 100 during operation of gas turbine system 10.

Figure 16:
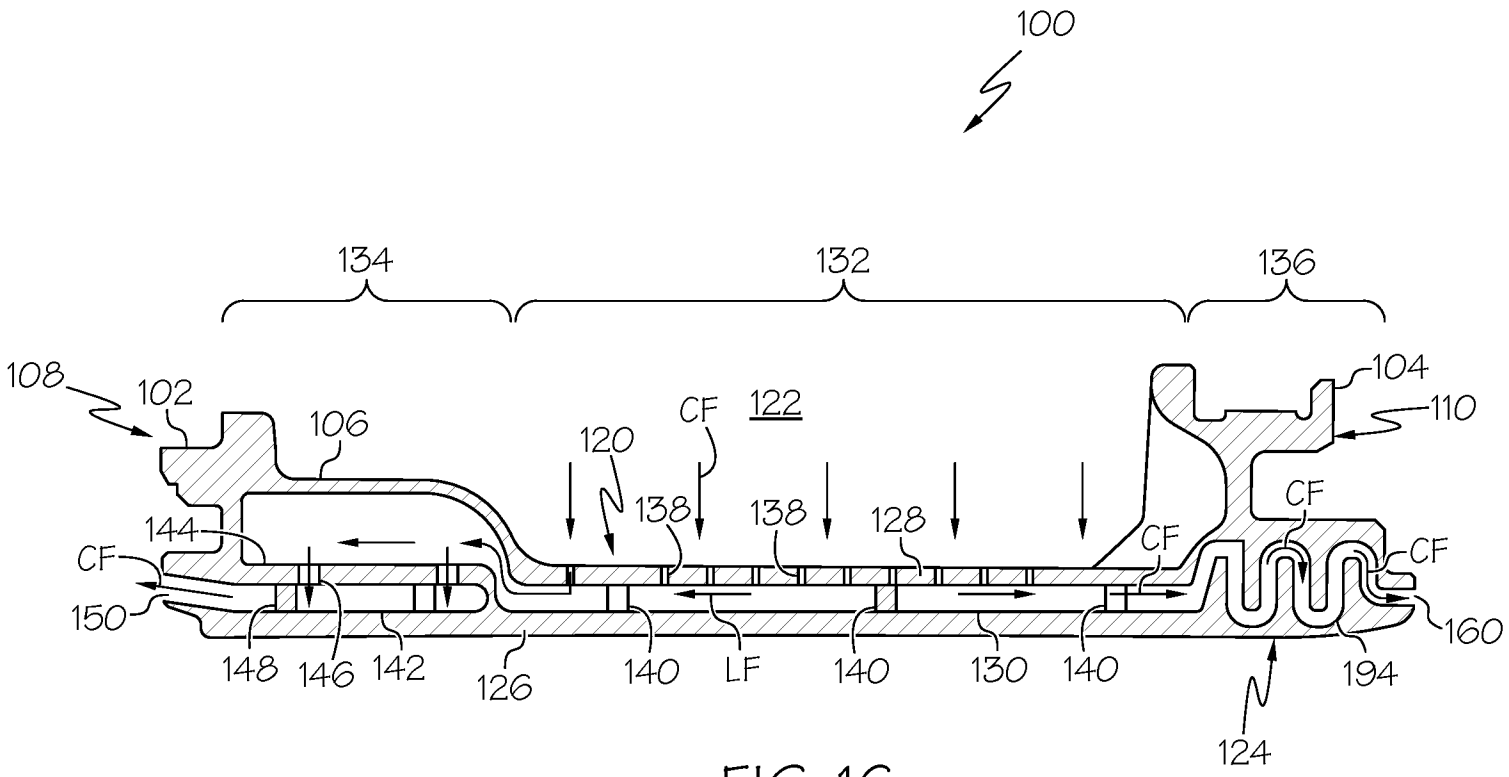
FIG. 16 shows a cross-sectional side view of the turbine shroud of FIG. 4, according to another embodiment of the disclosure.

Similar to FIG. 15, the non-limiting example of turbine shroud 100 shown in FIG. 16 may also only include first cooling passage 130 and second cooling passage 142. However, and with comparison to the non-limiting example shown in FIG. 15, first cooling passage 130 of turbine shroud 100 shown in FIG. 16 may include a distinct feature. For example, aft part 136 of first cooling passage 130 may include a substantially serpentine pattern 194. That is, and as shown in FIG. 16, aft part 136 of first cooling passage 130 may be formed to include serpentine pattern 194 that may extend, serpentine, and/or include a plurality of turns that span between base portion 126 and impingement portion 128. In the non-limiting example, serpentine pattern 194 formed in aft part 136 of first cooling passage 130 may be in fluid communication with second exhaust hole 160 extending through aft end 110 of unitary body 106 for turbine shroud 100. Serpentine pattern 194 formed in aft part 136 of first cooling passage 130 may aid in the heat transfer and/or cooling of turbine shroud 100 during operation of gas turbine system 10, as discussed herein. It is understood that the number of turns included in serpentine pattern 194 is illustrative. As such, serpentine pattern 194 formed in aft part 136 of first cooling passage 130 may include more or less turns than shown in FIG. 16. Additionally, it is understood that serpentine patter 194 may also be formed in forward part 134 of first cooling passage 130 in addition to, or alternative to, being formed in aft part 136 as shown in FIG. 16.

Figure 17:
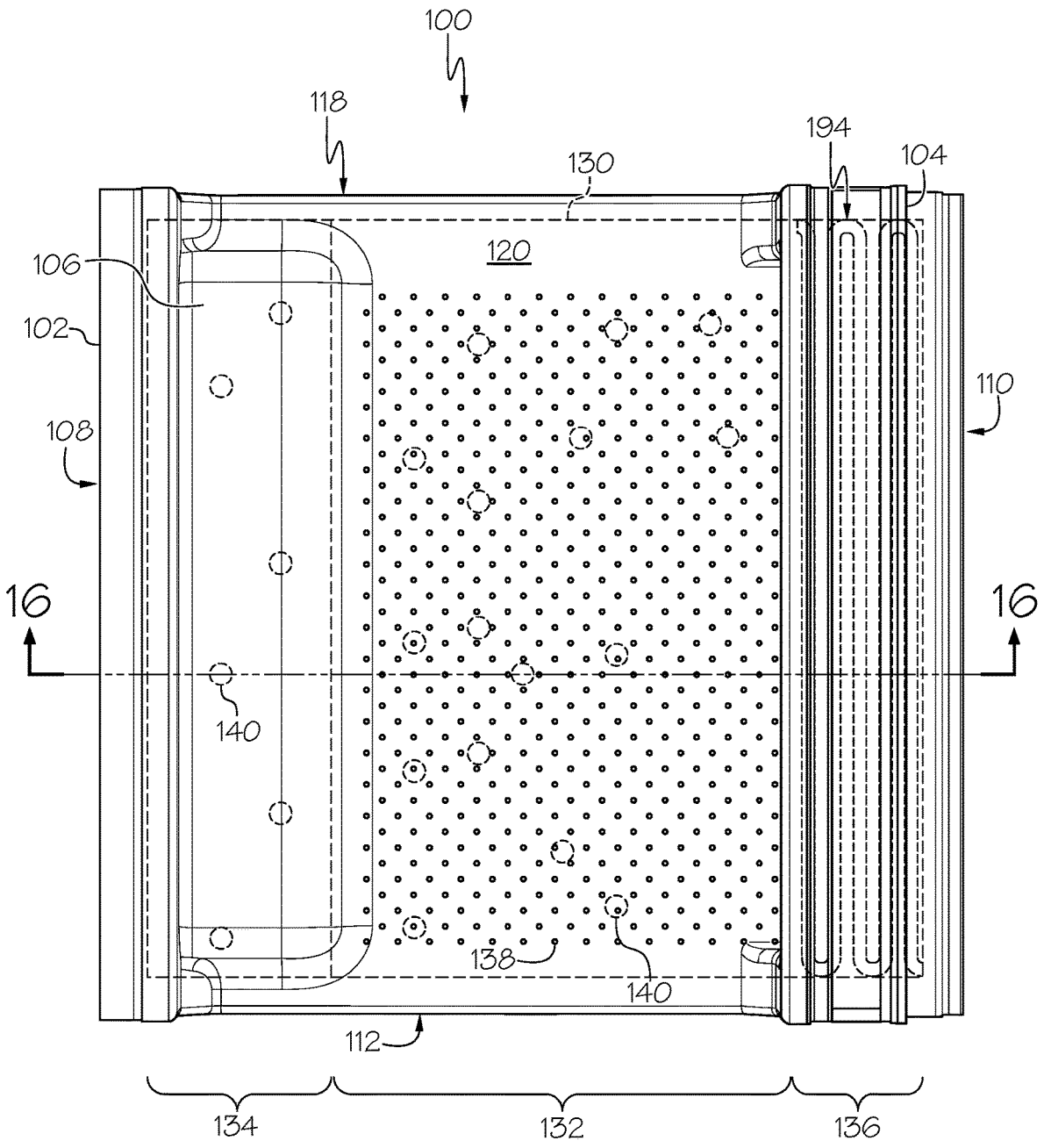
FIG. 17 shows a top view of a turbine shroud, according to other embodiments of the disclosure.
Figure 18:
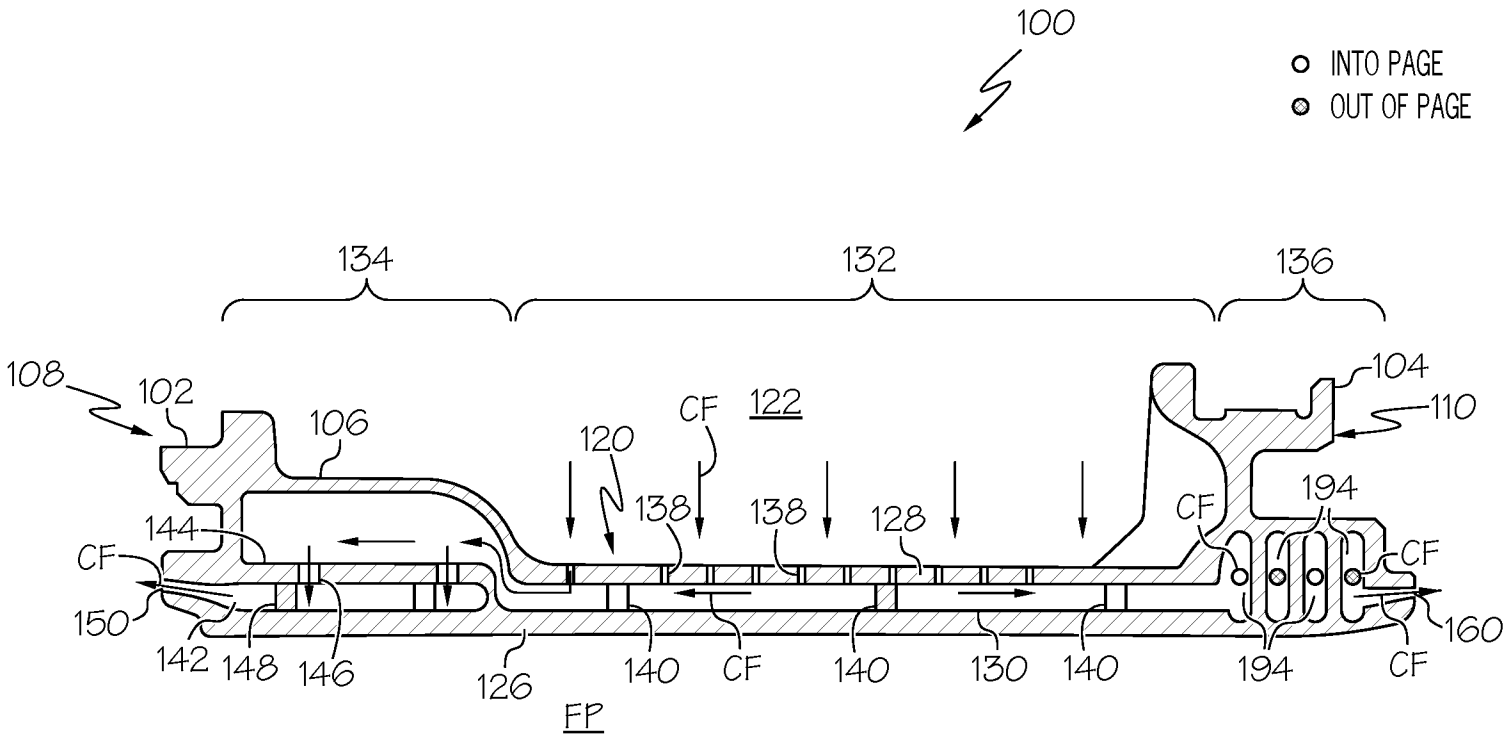
FIG. 18 shows a cross-sectional side view of the turbine shroud taken along line 18-18 in FIG. 17, according to other embodiments of the disclosure.

FIGS. 17 and 18 show various views of an additional non-limiting example of turbine shroud 100 of turbine 28 for gas turbine system 10 of FIG. 1. Specifically, FIG. 17 shows a top view of turbine shroud 100, and FIG. 18 shows a cross-sectional side view of turbine shroud 100. Turbine shroud 100 shown in FIGS. 17 and 18 show may include another non-limiting example of serpentine pattern 194 formed in aft part 136 of first cooling passage 130. That is, and as shown in FIGS. 17 and 18, aft part 136 of first cooling passage 130 may be formed to include serpentine pattern 194 that may extend, serpentine, and/or include a plurality of turns that span between first end 112 and second end 118 of unitary body 106. Each portion of the opening of serpentine pattern 194 of first cooling passage 130 may also radially extend between base portion 126 and impingement portion 128 of unitary body 106 for turbine shroud 100. In the non-limiting example, serpentine pattern 194 formed in aft part 136 of first cooling passage 130 may be in fluid communication with second exhaust hole 160 extending through aft end 110 of unitary body 106 for turbine shroud 100. Serpentine pattern 194 formed in aft part 136 of first cooling passage 130 may aid in the heat transfer and/or cooling of turbine shroud 100 during operation of gas turbine system 10, as discussed herein. As shown in FIG. 18, the cooling fluid (CF) flowing from central part 132 of first cooling passage 130 may flow through serpentine pattern 194, and back-and-forth between first end 112 and second end 118, before being exhausted from second exhaust hole 160. It is understood that the number of turns included in serpentine pattern 194 is illustrative. As such, serpentine pattern 194 formed in aft part 136 of first cooling passage 130 may include more or less turns than shown in FIGS. 17 and 18. Additionally, it is understood that serpentine patter 194 may also be formed in forward part 134 of first cooling passage 130 in addition to, or alternative to, being formed in aft part 136 as shown in FIGS. 17 and 18.

Although shown and described herein with respect to distinct embodiments, it is understood that turbine shroud 100 may include any combination of configurations shown in the non-limiting examples of FIGS. 3-18. For example, turbine shroud 100 may only include first cooling passage 130 that includes forward part 134 similar to that shown in the non-limiting example of FIG. 14, and aft part 136 similar to that shown in the non-limiting example of FIG. 15. In another non-limiting example, turbine shroud 100 including only first cooling passage 130 may forward part 134 similar to that shown in the non-limiting example of FIG. 14, and aft part 136 including serpentine pattern 194 similar to that shown in the non-limiting example of FIG. 18.

Technical effect is to provide a unitary body turbine shroud that includes a plurality of cooling passages formed therein. The unitary body of the turbine shroud allows for more complex cooling passage configurations and/or thinner walls for the turbine shroud, which in turn improves the cooling of the turbine shroud.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A turbine shroud coupled to a turbine casing of a turbine system, the turbine shroud comprising:
a unitary body including:
a forward end;
an aft end positioned opposite the forward end;
an outer surface facing a cooling chamber formed between the unitary body and the turbine casing; and
an inner surface facing a hot gas flow path for the turbine system;
a first cooling passage extending within the unitary body, the first cooling passage including a forward part positioned adjacent the forward end of the unitary body, an aft part positioned adjacent the aft end of the unitary body, and a central part positioned between the forward part and the aft part;
a plurality of impingement openings formed through the outer surface of the unitary body to fluidly couple the first cooling passage to the cooling chamber; and
a second cooling passage extending within the unitary body adjacent the forward end, the second cooling passage in fluid communication with the forward part of the first cooling passage, and
a third cooling passage extending within the unitary body adjacent the aft end, the third cooling passage in fluid communication with the aft part of the first cooling passage.

2. The turbine shroud of claim 1, wherein the unitary body further comprises a plurality of support pins positioned within the first cooling passage.

3. The turbine shroud of claim 1, wherein the unitary body further comprises at least one of:
a first rib formed adjacent the forward end, the first rib positioned between and separating the first cooling passage and the second cooling passage, or
a second rib formed adjacent the aft end, the second rib positioned between and separating the first cooling passage and the third cooling passage.

4. The turbine shroud of claim 3, wherein the unitary body further comprises at least one of:
a first plurality of impingement holes formed through the first rib, the first plurality of impingement holes fluidly coupling the first cooling passage and the second cooling passage, or
a second plurality of impingement holes formed through the second rib, the second plurality of impingement holes fluidly coupling the first cooling passage and the third cooling passage.

5. The turbine shroud of claim 1, wherein the unitary body further comprises at least one of:
a first plurality of support pins positioned within the second cooling passage, or
a second plurality of support pins positioned within the third cooling passage.

6. The turbine shroud of claim 1, wherein the first cooling passage further comprises:
a first cooling passage wall extending between two opposing sides of the unitary body, the first cooling passage wall positioned within the first cooling passage and extending parallel to the forward end and the aft end.

7. The turbine shroud of claim 6, wherein the first cooling passage includes:
a forward section formed between the forward end of the unitary body and the first cooling passage wall; and
an aft section formed between the aft end of the unitary body and the first cooling passage wall.

8. The turbine shroud of claim 1, wherein the first cooling passage further comprises:
a first cooling passage wall extending between two opposing sides of the unitary body, the first cooling passage wall positioned within the first cooling passage and extending parallel to the forward end and the aft end; and
a second cooling passage wall extending between the forward end and the aft end, parallel to the two opposing sides of the unitary body, the second cooling passage wall positioned within the first cooling passage and extending perpendicular to the first cooling passage wall.

9. The turbine shroud of claim 8, wherein the first cooling passage includes:
a first forward section formed between the forward end and the first cooling passage wall, the first forward section formed between a first side of the two opposing sides of the unitary body and the second cooling passage wall;
a second forward section formed between the forward end and the first cooling passage wall, the second forward section formed between a second side of the two opposing sides of the unitary body and the second cooling passage wall;
a first aft section formed between the aft end and the first cooling passage wall, the first aft section formed between the first side of the two opposing sides and the second cooling passage wall; and
a second aft section formed between the aft end and the first cooling passage wall, the second aft section formed between the second side of the two opposing sides and the second cooling passage wall.

10. The turbine shroud of claim 1, further comprising:
a first exhaust hole in fluid communication with one of the first cooling passage or the second cooling passage,
wherein the first exhaust hole extends through one of:
the forward end of the unitary body, or
the inner surface of the unitary body.

11. The turbine shroud of claim 10, further comprising:
a second exhaust hole in fluid communication with one of the first cooling passage or the third cooling passage,
wherein the second exhaust hole extends through one of:
the aft end of the unitary body, or
the inner surface of the unitary body.

12. A turbine system comprising:
a turbine casing; and
a first stage positioned within the turbine casing, the first stage including:
a plurality of turbine blades positioned within the turbine casing and circumferentially about a rotor;
a plurality of stator vanes positioned within the turbine casing, downstream of the plurality of turbine blades; and
a plurality of turbine shrouds positioned radially adjacent the plurality of turbine blades and upstream of the plurality of stator vanes, each of the plurality of turbine shrouds including:
a unitary body including:
a forward end;
an aft end positioned opposite the forward end;
an outer surface facing a cooling chamber formed between the unitary body and the turbine casing; and
an inner surface facing a hot gas flow path for the turbine system;

a first cooling passage extending within the unitary body, the first cooling passage including a forward part positioned adjacent the forward end of the unitary body, an aft part positioned adjacent the aft end of the unitary body, and a central part positioned between the forward part and the aft part;

a plurality of impingement openings formed through the outer surface of the unitary body to fluidly couple the first cooling passage to the cooling chamber; and a second cooling passage extending within the unitary body adjacent the forward end, the second cooling passage in fluid communication with the forward part of the first cooling passage, and a third cooling passage extending within the unitary body adjacent the aft end, the third cooling passage in fluid communication with the aft part of the first cooling passage.

13. The turbine system of claim 12, wherein the unitary body of each of the plurality of turbine shrouds further comprises:

a plurality of support pins positioned within the first cooling passage.

14. The turbine system of claim 12, wherein the unitary body of each of the plurality of turbine shrouds further comprises at least one of:

a first rib formed adjacent the forward end, the first rib positioned between and separating the first cooling passage and the second cooling passage, or a second rib formed adjacent the aft end, the second rib positioned between and separating the first cooling passage and the third cooling passage.

15. The turbine system of claim 14, wherein the unitary body of each of the plurality of turbine shrouds further comprises at least one of:

a first plurality of impingement holes formed through the first rib, the first plurality of impingement holes fluidly coupling the first cooling passage and the second cooling passage, or a second plurality of impingement holes formed through the second rib, the second plurality of impingement holes fluidly coupling the first cooling passage and the third cooling passage.

16. The turbine system of claim 12, wherein the unitary body of each of the plurality of turbine shrouds further comprises at least one of:

a first plurality of support pins positioned within the second cooling passage, or a second plurality of support pins positioned within the third cooling passage.

17. The turbine system of claim 12, wherein the first cooling passage of each of the plurality of turbine shrouds further comprises at least one of:

a first cooling passage wall extending between two opposing sides of the unitary body, the first cooling passage wall positioned within the first cooling passage and extending parallel to the forward end and the aft end, or a second cooling passage wall extending between the forward end and the aft end, parallel to the two opposing sides of the unitary body, the second cooling passage wall positioned within the first cooling passage and extending perpendicular to the first cooling passage wall.

18. The turbine system of claim 17, wherein each of the plurality of turbine shrouds further comprises at least one of:

a third cooling passage wall positioned within the second cooling passage and extending parallel to the two opposing sides of the unitary body, or a fourth cooling passage wall positioned within the third cooling passage and extending parallel to the two opposing sides of the unitary body.

19. The turbine system of claim 12, wherein each of the plurality of turbine shrouds further comprises:

a first exhaust hole in fluid communication with one of the first cooling passage or the second cooling passage, the first exhaust hole extending through one of the forward end of the unitary body, or the inner surface of the unitary body; and a second exhaust hole in fluid communication with one of the first cooling passage or the third cooling passage, the second exhaust hole extending through one of the aft end of the unitary body, or the inner surface of the unitary body.

20. The turbine system of claim 12, wherein the aft part of the first cooling passage formed in the unitary body includes a substantially serpentine pattern.

* * * * *